US007481470B2

(12) United States Patent
Eenigenburg et al.

(10) Patent No.: US 7,481,470 B2
(45) **Date of Patent: *Jan. 27, 2009**

(54) INTEGRATED TILT/SASH LOCK ASSEMBLY

(75) Inventors: Mark B. Eenigenburg, Lansing, IL (US); Dean Pettit, St. John, IN (US); Mark V. Murphy, Oak Park, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/274,753

(22) Filed: Nov. 15, 2005

(65) Prior Publication Data

US 2006/0207181 A1 Sep. 21, 2006

Related U.S. Application Data

(63) Continuation of application No. 10/290,092, filed on Nov. 7, 2002, now Pat. No. 7,070,211.

(60) Provisional application No. 60/413,930, filed on Sep. 25, 2002, provisional application No. 60/411,839, filed on Sep. 19, 2002, provisional application No. 60/403,565, filed on Aug. 14, 2002, provisional application No. 60/376,582, filed on Apr. 30, 2002, provisional application No. 60/370,318, filed on Apr. 5, 2002, provisional application No. 60/347,823, filed on Nov. 7, 2001.

(51) Int. Cl.
*E05C 3/04* (2006.01)
*E05C 1/10* (2006.01)

(52) U.S. Cl. ..... 292/241; 292/175; 292/DIG. 20; 292/DIG. 47; 49/185

(58) Field of Classification Search ..... 292/38, 292/40, 42, 137, 143, 145, 150, 153, 163, 292/165, 171, 173, DIG. 20, DIG. 47, 175, 292/241; 49/185
See application file for complete search history.

(56) References Cited

U.S. PATENT DOCUMENTS 166,842 A 8/1875 Berryman (Continued)

FOREIGN PATENT DOCUMENTS

GB 341207 1/1931

(Continued)

OTHER PUBLICATIONS

P. 21. Home Protection Hardware Catalog Pricelist, dated Jul. 1986.

*Primary Examiner*—Carlos Lugo
(74) *Attorney, Agent, or Firm*—Banner & Witcoff, Ltd.

(57) ABSTRACT

An integrated sash lock and tilt latch assembly for a sash window slidable within a master frame, including a handle movable among a first, a second and a third position to adjust the assembly among a respective locked, unlocked and tiltable position. The integrated assembly further comprises a rotor coupled to the handle and having a locking cam. The integrated assembly also includes a keeper adapted to be connected to an upper sash window. The integrated assembly further includes a latch bolt housing having a latch bolt slidably disposed therein and a spring for biasing the latch bolt towards the master frame. The integrated assembly further includes a connector coupled proximate a first end to the latch bolt and operably coupled proximate a second end to the rotor.

15 Claims, 32 Drawing Sheets

U.S. PATENT DOCUMENTS 176,360 A 6/1876 Cooper
178,360 A 6/1876 Cooper
201,146 A 3/1878 Adler
336,302 A 2/1886 Dudgeon
346,788 A 8/1886 Teufel
376,252 A 1/1888 McIntyre
410,728 A 9/1889 Brown
480,148 A 8/1892 Theby
509,941 A 12/1893 Perry
512,593 A 1/1894 Webster et al.
526,118 A 9/1894 Sharp
551,242 A 12/1895 Wallace
590,225 A 9/1897 Hill
722,162 A 3/1903 St. Louis
759,642 A 5/1904 Sparks
878,206 A 2/1908 Johnson
948,628 A 2/1910 Jefferis
966,063 A 8/1910 Toothaker
980,131 A 12/1910 Shean
998,642 A 7/1911 Shean
1,006,211 A 10/1911 Hermon
1,041,803 A 10/1912 Kilburn
1,051,918 A 2/1913 Rowley
1,059,999 A 4/1913 James et al.
1,141,437 A 6/1915 Unterlender
1,243,115 A 10/1917 Shur
1,253,810 A 1/1918 Gianninoto
1,270,740 A 6/1918 Keyes
1,393,628 A 10/1921 Leichter
1,550,532 A 8/1925 French
1,552,690 A 9/1925 Frantz
1,704,946 A 3/1929 Lindgren
1,712,792 A 5/1929 Hansen
1,715,957 A 6/1929 Stein
1,794,171 A 2/1931 Grutel
1,864,253 A 6/1932 McIntyre
1,869,274 A 7/1932 Phillips
1,901,974 A 3/1933 Macy
1,922,062 A 8/1933 Sullivan
1,964,114 A 6/1934 Gerlach et al.
2,095,057 A 10/1937 Corrado
2,122,661 A 7/1938 Rightmyer
2,126,995 A 8/1938 Kingdon
2,272,145 A 2/1942 Anderson et al.
2,369,584 A 2/1945 Lundholm
2,452,521 A 10/1948 Johnson et al.
2,500,849 A 3/1950 Menns
2,537,736 A 1/1951 Carlson
2,766,492 A 10/1956 Day et al.
2,818,919 A 1/1958 Sylvan
3,027,188 A 3/1962 Eichstadt
3,187,526 A 6/1965 Moler
3,362,740 A 1/1968 Burns
3,438,153 A 4/1969 Lemme
3,599,452 A 8/1971 Yokohama et al.
3,683,652 A 8/1972 Halopoff et al.
3,811,718 A 5/1974 Bates
3,919,808 A 11/1975 Simmons
4,068,871 A 1/1978 Mercer
4,151,682 A 5/1979 Schmidt
4,165,894 A 8/1979 Wojciechowski
4,227,345 A 10/1980 Durham, Jr.
4,253,688 A 3/1981 Hosooka
4,303,264 A 12/1981 Uehara
4,305,612 A 12/1981 Hunt et al.
4,392,329 A 7/1983 Suzuki
4,470,277 A 9/1984 Uyeda
4,475,311 A 10/1984 Gibson
4,525,952 A 7/1985 Cunningham et al.
4,580,366 A 4/1986 Hardy
4,587,759 A 5/1986 Gray
4,624,073 A 11/1986 Randall
4,639,021 A 1/1987 Hope
4,643,005 A 2/1987 Logas
4,827,685 A 5/1989 Schmidt
4,893,849 A 1/1990 Schlack
4,922,658 A 5/1990 Coddens
4,949,506 A 8/1990 Durham, Jr.
4,961,286 A 10/1990 Bezubic
5,072,464 A 12/1991 Draheim et al.
5,076,015 A 12/1991 Manzalini
5,087,087 A 2/1992 Vetter et al.
5,087,088 A 2/1992 Milam
5,090,750 A 2/1992 Lindqvist
5,127,685 A 7/1992 Dallaire et al.
5,139,291 A 8/1992 Schultz
5,143,412 A 9/1992 Lindqvist
5,165,737 A 11/1992 Riegelman
5,183,310 A 2/1993 Shaughnessy
5,244,238 A 9/1993 Lindqvist
5,274,955 A 1/1994 Dallaire et al.
5,341,752 A 8/1994 Hambleton
5,398,447 A 3/1995 Morse
5,437,484 A 8/1995 Yamada
5,454,609 A 10/1995 Slocomb et al.
5,560,149 A 10/1996 Lafevre
5,636,475 A 6/1997 Nidelkoff
5,688,000 A 11/1997 Dolman
5,715,631 A 2/1998 Kailian et al.
5,791,700 A 8/1998 Biro
5,829,196 A 11/1998 Maier
5,873,199 A 2/1999 Meunier et al.
5,901,499 A 5/1999 Delaske et al.
5,911,763 A 6/1999 Quesada
5,970,656 A 10/1999 Maier
5,992,907 A 11/1999 Sheldon et al.
6,086,121 A 7/2000 Buckland
6,135,510 A 10/2000 Diginosa
6,139,071 A 10/2000 Hopper
6,142,541 A 11/2000 Rotondi
6,155,615 A 12/2000 Schultz
6,161,335 A 12/2000 Beard et al.
6,176,041 B1 1/2001 Roberts
6,178,696 B1 1/2001 Liang
6,183,024 B1 2/2001 Schultz et al.
6,209,931 B1 4/2001 Stoutenborough et al.
6,217,087 B1 4/2001 Fuller
6,230,443 B1 5/2001 Schultz
6,257,303 B1 7/2001 Coubray et al.
6,279,266 B1 8/2001 Searcy
6,422,287 B1 7/2002 Wilke
6,546,671 B2 4/2003 Mitchell et al.
6,565,133 B1 5/2003 Timothy
6,588,150 B1 7/2003 Wong et al.
6,592,155 B1 7/2003 Lemley et al.
6,607,221 B1 8/2003 Elliott
6,631,931 B2 * 10/2003 Magnusson ..... 292/175
6,817,142 B2 11/2004 Marshik
6,871,885 B2 3/2005 Goldenberg et al.

FOREIGN PATENT DOCUMENTS

GB 2026594 2/1980

* cited by examiner

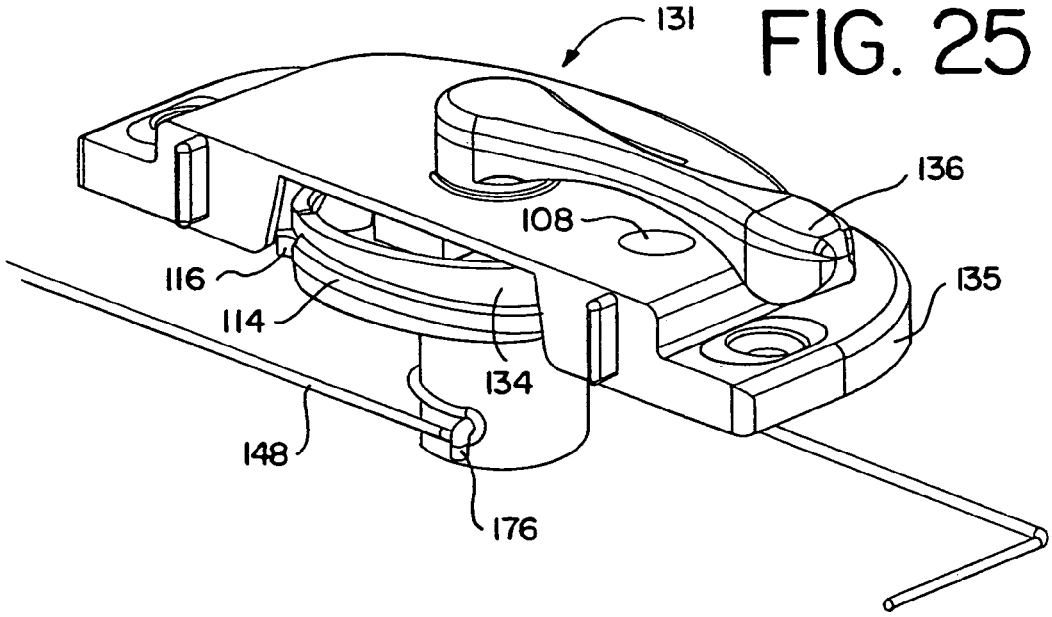
FIG. 25
FIG. 26
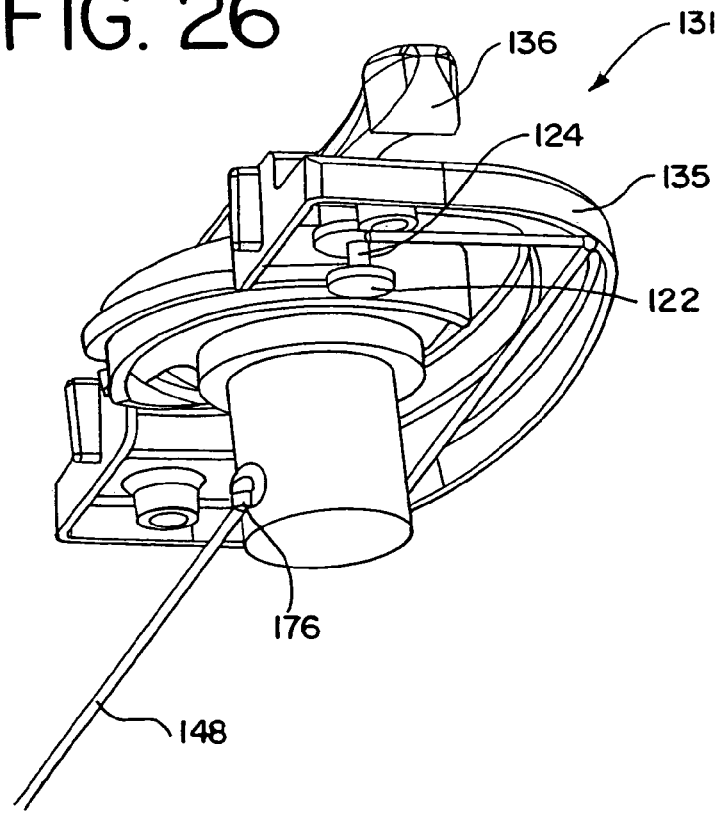

FIG. 32
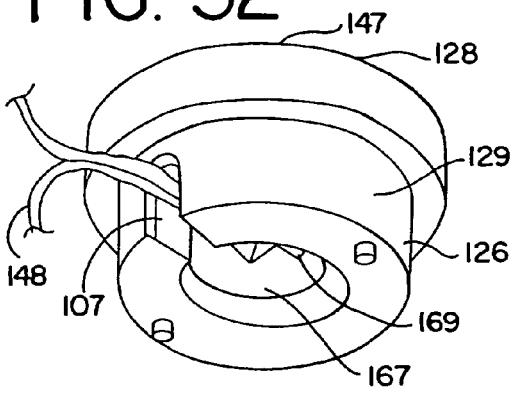
FIG. 33
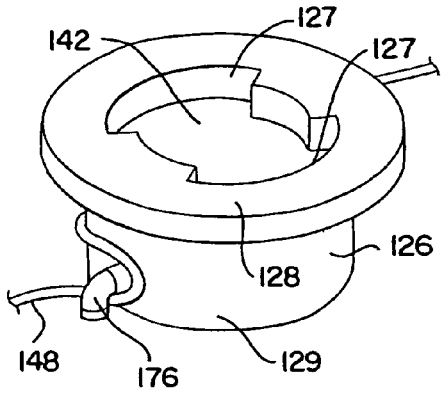
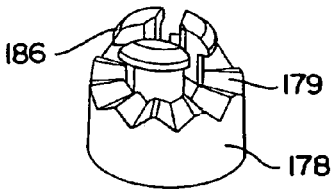
FIG. 34
FIG. 35
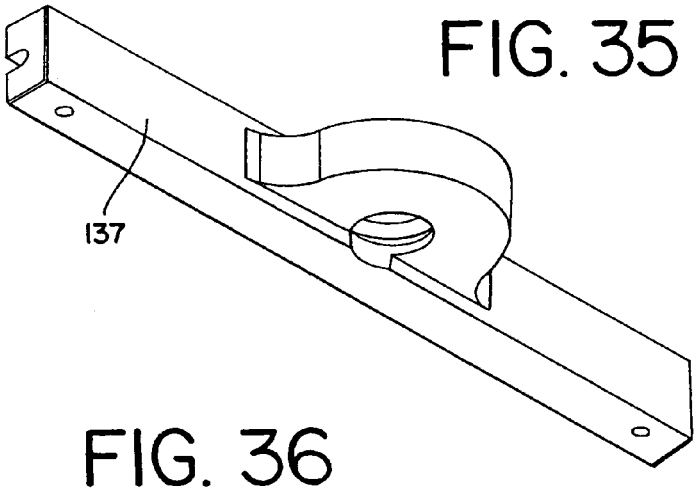
FIG. 36
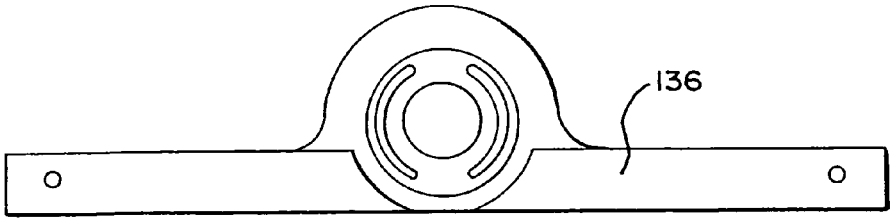

236
290
293
294
230a
242
230b
248
288
249
250
256
252

236
294
230a
242
248
230b
288
256
250
260
252
254
258

290"
294
300
248"
294
296
250
250a
264
260
252
288
258
260
248
294
293
290
291
250
250a
260
252
288
251
250b
248
294
236
242
293
290
292
278'

INTEGRATED TILT/SASH LOCK ASSEMBLY

CROSS-REFERENCE TO RELATED APPLICATIONS

This application is a continuation of U.S. application Ser. No. 10/290,092, filed Nov. 7, 2002, now U.S. Pat. No. 7,070,211 which is incorporated herein by reference and made a part hereof, and upon which a claim of priority is based. U.S. application Ser. No. 10/290,092 claims the benefit of U.S. Provisional Application Nos. 60/347,823, filed Nov. 7, 2001; 60/370,318, filed Apr. 5, 2002; 60/376,582, filed Apr. 30, 2002; 60/403,565, filed Aug. 14, 2002; 60/411,839, filed Sep. 19, 2002; and 60/413,930, filed Sep. 25, 2002, which applications are incorporated herein by reference and made a part hereof.

FEDERALLY SPONSORED RESEARCH OR DEVELOPMENT

Not applicable.

TECHNICAL FIELD

The present invention relates generally to sash window hardware and, more particularly, to an integrated tilt/sash lock assembly that performs a sash lock operation and a tilt-latch operation in a sash window assembly.

BACKGROUND OF THE INVENTION

Sash window assemblies are well-known. In one typical configuration, a sash window is slidably supported within a master frame. The master frame of the sash window assembly typically has opposed, vertically extending guide rails to enable vertical reciprocal sliding movement of the sash window while cooperatively engaged with the guide rails. The sash window has a top sash rail, a base and a pair of stiles cooperatively connected together at adjacent extremities thereof to form a sash frame, usually a rectangular frame. In another conventional configuration, a double-hung sash window assembly has a lower sash window and an upper sash window that are mounted for slidable movement along adjacent parallel guide rails in the master frame. To restrain upward sliding of the lower sash window, the sash window assembly typically employs a sash lock assembly generally consisting of a locking cam and a keeper. When it is desirable to lock the window to prevent upward sliding, an operator rotates the locking cam to engage the keeper.

The sash windows in these sash window assemblies are often constructed to allow for the sash windows to be tilted inward. This allows, for example, a homeowner to easily clean an outer surface of a glass pane of the sash window from inside of a dwelling. To allow for tilting, the sash window is pivotally mounted in the master frame at the base of the sash window, and the sash window is equipped with a tilt-latch. Typically, a tilt-latch is installed in opposite ends of the top rail of the sash window. The tilt-latches have a latch bolt that is biased outwardly for engagement with guide rails of the master frame. An operator manually engages the latch bolts and simultaneously retracts each latch bolt into the top rail. Once retracted, the latch bolts are then disengaged from the guide rails wherein the sash window can then be titled inward. In this configuration, an operator must use two hands to inwardly pivot the sash window since the latch bolts are required to be simultaneously retracted. This simultaneous retraction can be difficult for some operators. In addition, certain sash lock and tilt-latch designs have had an assortment of complex structures that are expensive and difficult to assemble and operate.

Some attempts have been made to provide an assembly that has a single actuator that operates both the sash lock and tilt-latch. U.S. Pat. Nos. 5,992,907; 5,398,447 and 5,090,750 are some examples of such structures. While this combined assembly assists in the overall operation of the sash window assembly, an assembly design that is simple in construction, is easy to assembly, and provides smooth, reliable operation is still difficult to achieve. Nevertheless, it remains desirable to provide an assembly that integrates the sash lock operation and the tilt latch operation.

Furthermore, it is desirable to provide a sash window assembly that has minimal exposed hardware such as the sash lock and tilt-latches. For example, it is desirable to provide a sash window having a substantially smooth line of sight. Many tilt-latches are mounted on a top surface of the top rail of the sash window. While a flush-mount tilt-latch is positioned substantially within the top rail, a top portion of the latch is still visible on the top rail. Similarly, sash lock assemblies are typically mounted on the top surface of the top rail of the sash window. Thus, it is desirable to provide a sash window assembly, that utilizes a sash lock and tilt-latches, that has a substantially smooth line of sight across the assembly.

The present invention is provided to solve these and other problems.

SUMMARY OF THE INVENTION

An integrated tilt/sash lock assembly for a sash window assembly is disclosed. The integrated assembly provides a sash lock operation and a tilt-latch operation.

According to one aspect of the present invention, the integrated assembly comprises a handle movable among a first, a second and a third position to adjust the assembly among a respective locked, unlocked and tiltable position. The integrated assembly further comprises a rotor coupled to the handle. The rotor has a locking cam and a pair of slots disposed therein. The integrated assembly also includes a keeper adapted to be supported by the sash window. The integrated assembly further includes a latch bolt housing having a latch bolt slidably disposed therein and a spring for biasing the latch bolt towards one of the guide rails. The integrated assembly further has a connector coupling the latch bolt to the rotor. The connector has a guide pin which slidably engages the slot in the rotor.

According to another aspect of the present invention, the integrated assembly comprises a handle movable among a first, a second and a third position to adjust the assembly among a respective locked, unlocked and tiltable position. The integrated assembly further comprises a rotor coupled to the handle. The rotor has a locking cam. The integrated assembly also includes a keeper adapted to be supported by the sash window. The integrated assembly further includes a latch bolt housing having a latch bolt slidably disposed therein and a spring for biasing the latch bolt towards one of the guide rails. The integrated assembly further has a connector coupling the latch bolt to the rotor. The connector is coupled proximate a first end to the latch bolt and proximate a second end to a first end of a linkage member. The second end of each of the linkage member is pivotably coupled to the rotor.

According to another aspect of the invention, the integrated assembly has rotor assembly having a rotor connected to a spool. A connector has one end connected to the spool and another end connected to the latch bolt. An actuator is connected to the rotor assembly. The actuator has a locked position wherein the rotor engages the keeper. The actuator is moveable to an unlocked position wherein the rotor assembly is disengaged from the keeper. The actuator is further moveable to a tiltable position wherein the connector retracts the latch bolt from the master frame.

According to another aspect of the invention, the integrated assembly has means for preventing the actuator from being moved from the unlocked position to the tiltable position.

According to a further aspect of the invention, an integrated assembly has a handle moveable among a first position, a second position, and a third position to adjust the assembly among a respective locked, unlocked and tiltable position. A rotor is coupled to the handle and has a locking cam. The rotor is positioned in the top rail of a lower sash window. A pawl is operably associated with the handle and has a base and an appending member. A keeper is provided and is adapted to be connected to an upper sash window. A latch bolt is adapted to be slidable within the top rail of the lower sash window. A connector has a first end coupled to the latch bolt and a second end operably engaged with the appending member of the pawl. Rotation of the handle rotates the pawl wherein the appending member engages the connector to retract the latch bolt.

According to another aspect of the invention, a sash lock handle is provided that is capable of being retracted into the top rail of the lower sash window. In the retracted position, the sash lock handle is substantially flush with a top surface of the top rail.

These and other objects and advantages will be made apparent from the following description of the drawings and detailed description of the invention.

BRIEF DESCRIPTION OF THE DRAWINGS

FIG. 25 is a top perspective view illustrating a portion of one embodiment of the sash lock mechanism of the integrated assembly of FIG. 19;

FIG. 26 is a bottom perspective view illustrating the portion of the sash lock mechanism of FIG. 19;

FIG. 32 is a perspective view illustrating a spool used in the integrated assembly of FIG. 19;

FIG. 33 is a perspective view illustrating an alternative embodiment of the spool used in the integrated assembly of FIG. 19;

FIG. 34 is a perspective view of a retaining member or fastener used in connection with the spool of FIG. 32;

FIG. 35 is a perspective view illustrating a spool support member used in connection with the integrated assembly of FIG. 19;

FIG. 36 is a top view illustrating the spool support member of FIG. 35;

DETAILED DESCRIPTION

Figure 1:
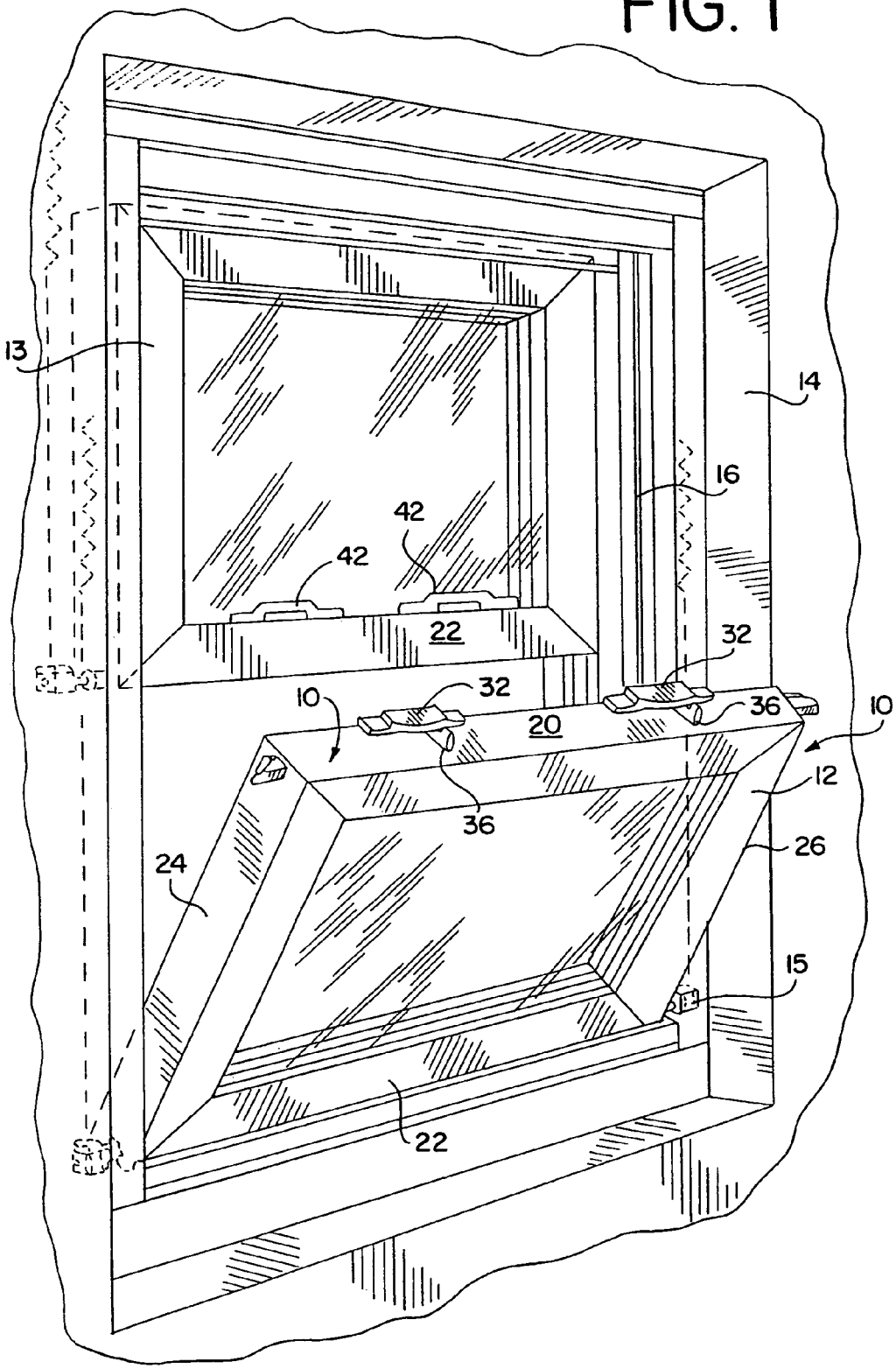
FIG. 1 a perspective view of a sash window assembly incorporating the present invention.

While this invention is susceptible of embodiment in many different forms, there are shown in the drawings and will herein be described in detail, preferred embodiments of the invention with the understanding that the present disclosures are to be considered as exemplifications of the principles of the invention and are not intended to limit the broad aspects of the invention to the embodiments illustrated.

A sash window assembly 10 is shown in FIG. 1. The particular sash window assembly 10 in FIG. 1 is a double-hung window assembly having a first or lower sash window 12 and a second or upper sash window 13 installed in a master frame 14. The lower sash window 12 is pivotally mounted to the master frame 14 by a sash balance/brake shoe assembly 15. The master frame 14 has opposed, vertically extending guide rails 16. The lower sash window 12 has a top rail 20, a base 22 and a pair of stiles 24, 26, cooperatively connected together at adjacent extremities thereof to form a sash frame, typically rectangular although other shapes are possible. The upper sash window 13 is similarly constructed. The sash windows and master frame could be made from extrusions or pulltrusions that are filled with fiberglass, epoxy, plastic, or wood chips. These structures could also be solid and made from wood, masonite, pressboard, composite materials, or other materials as well including aluminum.

Figure 2:
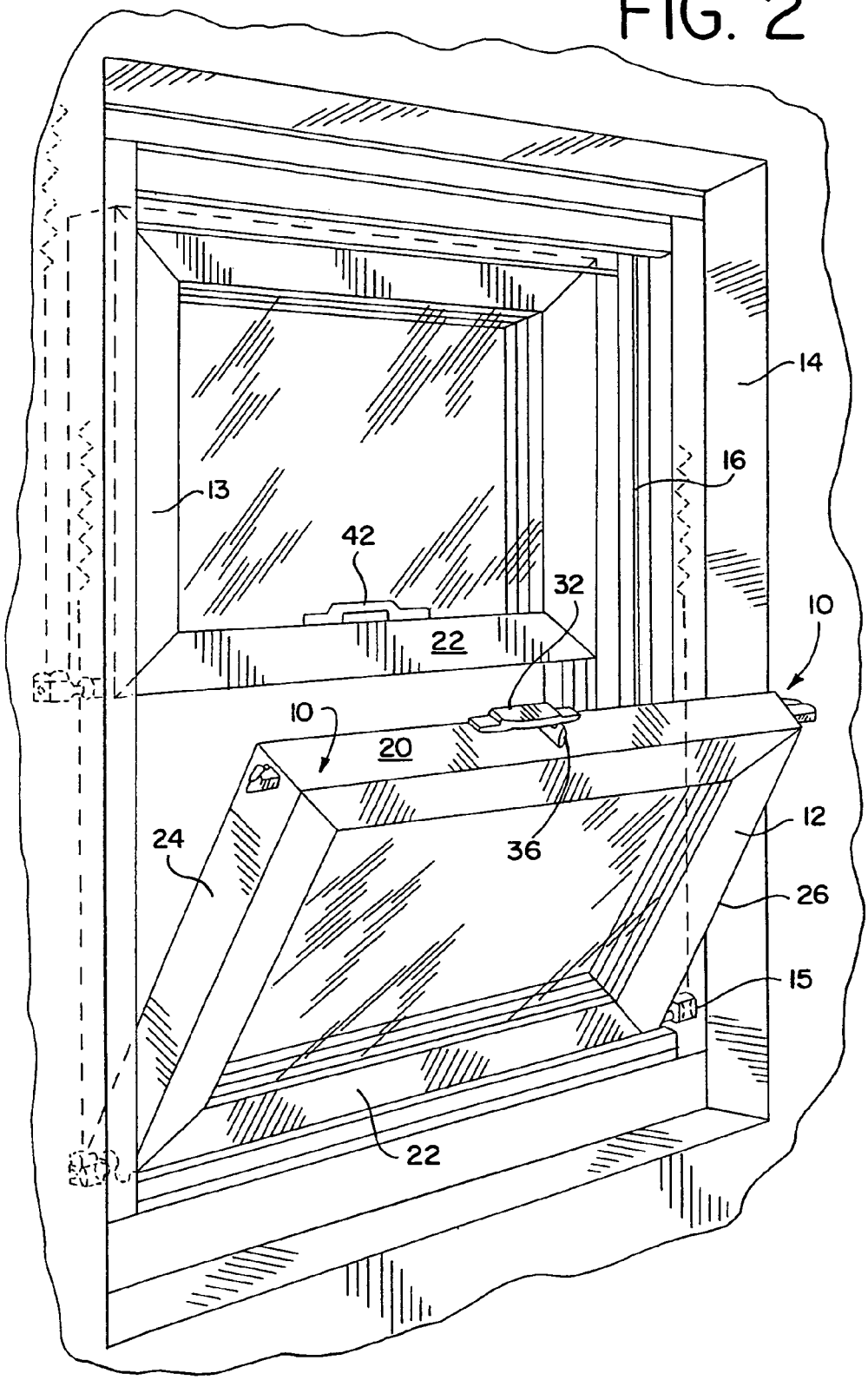
FIG. 2 a perspective view of another embodiment of a sash window assembly incorporating the present invention.

In accordance with the invention, the sash window assembly 10 includes an integrated tilt/sash lock assembly 30. For ease of description, the integrated tilt/sash lock assembly may be referred to as the integrated assembly 30. The integrated assembly 30 generally includes a sash lock mechanism **30*a* and a tilt-latch mechanism 30b. The sash lock mechanism 30*a* provides a sash lock operation, and the tilt-latch mechanism 30*b* provides a tilt-latch mechanism. As explained in greater detail below, the integrated assembly 30 has a locked position, an unlocked position and a tiltable position. In one preferred embodiment, the integrated assembly 30 has a single sash lock mechanism 30*a* and a single tilt-latch mechanism 30*b*, sometimes referred to as a single integrated assembly. A pair of single integrated assemblies 30 may be utilized in a sash window assembly 10 (See FIG. 1). It is further understood that the integrated assembly 30 may include a single sash lock mechanism 30*a* and a pair of tilt-latch mechanisms 30*b* (See FIG. 2**), sometimes referred to as a dual integrated assembly.

FIGS. 1-18 illustrate a first set of embodiments of the integrated assembly 30 according to the present invention. The sash lock mechanism **30*a* of the integrated assembly 30 will first be described and then the tilt-latch mechanism 30*b* of the integrated assembly will be described. The interaction of the sash lock mechanism 30*a* and the tilt latch mechanism 30*b*** will then be described in greater detail below.

Figure 3:
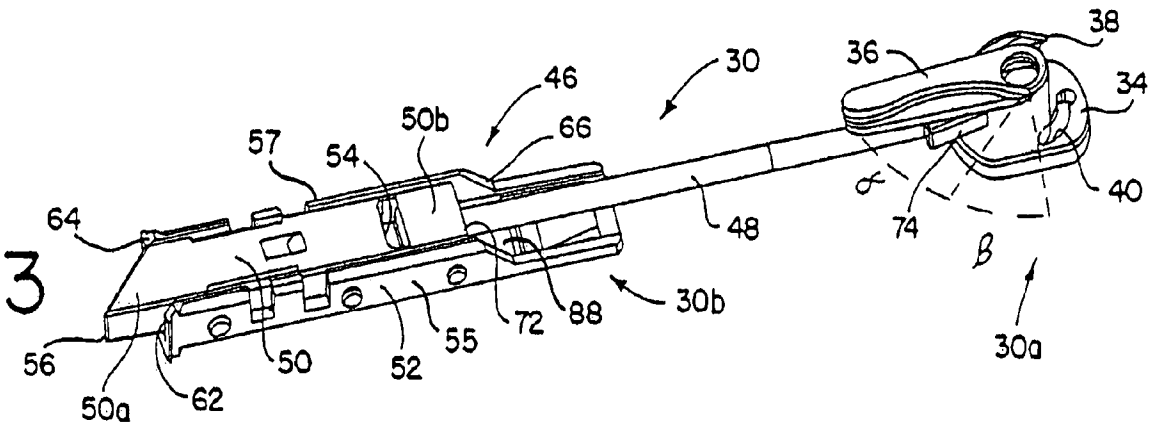
FIG. 3 is a perspective view of an integrated tilt/sash lock assembly of the present invention showing a sash lock mechanism and a tilt-latch mechanism.

As shown in FIGS. 3-6, the sash lock mechanism **30*a* is generally comprised of a sash lock system 31 and a keeper 42. The sash lock system 31 generally includes a sash lock housing.32, a rotor 34 and an actuator 36 typically in the form of a sash lock handle 36. As shown in FIG. 3, the sash lock housing 32 could be omitted wherein the sash lock handle 36 would fit through an opening in the top rail 20**.

The sash lock housing 32 generally accommodates the rotor 34 and has an opening to allow the handle 36 to be connected to the rotor 34. The sash lock housing 32 is typically mounted to a top surface of the top rail 20 of the lower sash window 12. The rotor 34 has a generally annular peripheral surface having a locking end 38. The rotor 34 has a central opening to receive the handle 36. The rotor 34 further has a pair of slots 40 circumferentially spaced from the central opening. In one embodiment of the present invention, the slots 40 are kidney-shaped. The handle 36 has a shaft 37 that is connected to the rotor 34. The shaft 37 passes through the opening of the sash lock housing 32 and is received by the central opening of the rotor 34. The handle 36 is made preferably of glass filled nylon. The rotor 34 is preferably made of glass filled nylon or zinc. However, it is contemplated that the handle 36 and rotor 34 be made from any suitable material.

Referring to FIGS. 1,2 and 4-6, the keeper 42 of the sash lock mechanism 30*a* is generally a bracketed structure having an opening 44. The keeper 42 is generally designed to be mounted on the base 22 of the upper sash window 13. The keeper 42 confronts the sash lock system 31 when the sash windows 12,13 are in their respective closed positions. As explained in greater detail below, the opening 44 of the keeper 42 receives the locking end 38 of the rotor 34 when the integrated assembly 30 is in the locked position. The keeper 42 is preferably made of nylon. However, it is contemplated that the keeper 42 be made of any material suitable for the applications described herein.

As shown in FIGS. 3-6, the tilt-latch mechanism 30*b* is generally comprised of a latch bolt assembly 46 and a connector 48. The latch bolt assembly 46 generally includes a latch bolt 50, a latch bolt housing 52 and a biasing means 54.

The latch bolt 50 has a first end 50*a*, a second end 50*b*. A beveled nose 56 extends from the first end 50*a* of the latch bolt 50 and is adapted for engaging a respective one of the guide rails 16 of the master frame 14. The latch bolt housing 52, described in greater detail below, receives and slidably supports the latch bolt 50 wherein the latch bolt 50 is disposed within the latch bolt housing 52.

As further shown in FIGS. 3-6, the latch bolt housing 52 can take many different forms. In one preferred embodiment, the latch bolt housing 52 has a bottom wall 58 and a pair of opposing side walls 60 extending from the bottom wall 58 to form a channel-like member. The latch bolt housing 52 further has a first end 64, a second end 66 and an outward end opening 62 adjacent the first end 64. In a preferred embodiment, the latch bolt housing 52 is made of a molded plastic or other polymeric material. The outward end opening 62 provides for allowing the nose 56 of the latch bolt 50 to extend past the latch bolt housing 52 and engage the guide rail 16 of the master frame 14.

In the embodiment of the latch bolt housing 52 shown in FIGS. 3-7, the bottom wall 58 of the latch bolt housing 52 has a first tab 68 depending from the bottom wall 58 and a second tab 70 depending from the bottom wall 58. The first and second tabs 68, 70 are located between and spaced from the first and second ends of the latch bolt housing 52. The tabs 68, 70 are generally aligned along and extend from a longitudinal axis of the bottom wall 58 of the latch bolt housing 52. The first and second depending tabs 68, 70 are adapted to be received by openings in the top rail as will be described below. The tabs 68, 70 are generally positioned along the bottom wall 58 at specific locations relative to one another to most optimally allow for tolerance variations that occur during manufacturing of the sash window, and more particularly, variations in the openings punched into the top rail that receive the tabs 68, 70. Such structures is further disclosed in commonly owned patent to Schultz, U.S. Pat. No. 6,230,443, entitled "Hardware Mounting," the specification of which is expressly incorporated herein by reference. The present invention, however, is not intended to be limited by the specific disclosure of the latch bolt housing of U.S. Pat. No. 6,230,443, or the latch bolt housing 52 described herein. Instead, as would be known to one of ordinary skill, any latch bolt housing 52 in which a latch bolt may suitably be disposed may be employed without departing from the present invention.

As further shown in FIGS. 3-6, the biasing means 54 is positioned in the latch bolt housing 52 and is designed to bias the latch bolt 50. In a preferred embodiment, the biasing means 54 is a spring. Generally, the spring biases the latch bolt 50 through the outward end opening 62 of the latch bolt housing 54. More specifically, the spring 54 has one end positioned abutting a wall of the latch bolt and the other end of the spring abutting a spring stop wall of the latch bolt housing 52. It is understood that other biasing means 54 known in the art could be employed. For example, the biasing means 54 may be a pressure activated mechanism, a cam, a compressed material with resilient characteristics or any other mechanisms suitable for biasing the latch bolt 50. The combination of the spring 54 and latch bolt 50 provides for releasably securing the sash window to the master frame 16.

As further shown in FIGS. 3-6, the connector 48 of the tilt-latch mechanism 30b generally connects the latch bolt 50 to the sash lock mechanism 30*a*. The connector 48 has a first end 72 and an opposed second end 74. The first end 72 of the connector 48 is coupled to the latch bolt 50. The opposed second end 74 of the connector 48 is coupled to the rotor 34. According to one embodiment of the present invention, the connector 48 is a flexible cord. It is contemplated, however, that the connector 48 be rigid or semi-rigid connecting rod.

Figure 4:
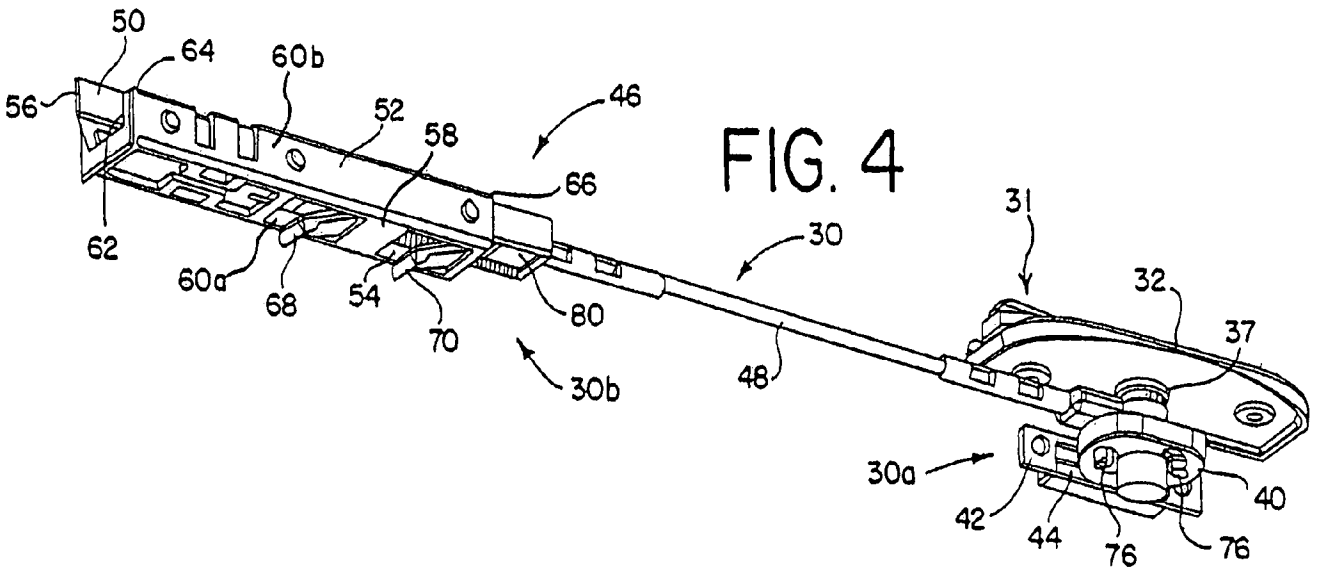
FIG. 4 is another perspective view of the integrated tilt/sash lock assembly of the present invention.
Figure 5:
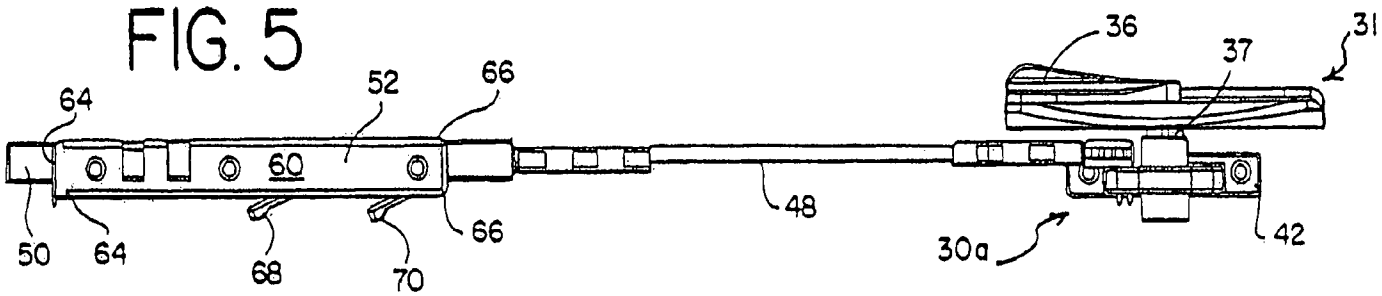
FIG. 5 is a side view of the assembly illustrating the sash lock and tilt-latch mechanisms of the present invention.
Figure 6:
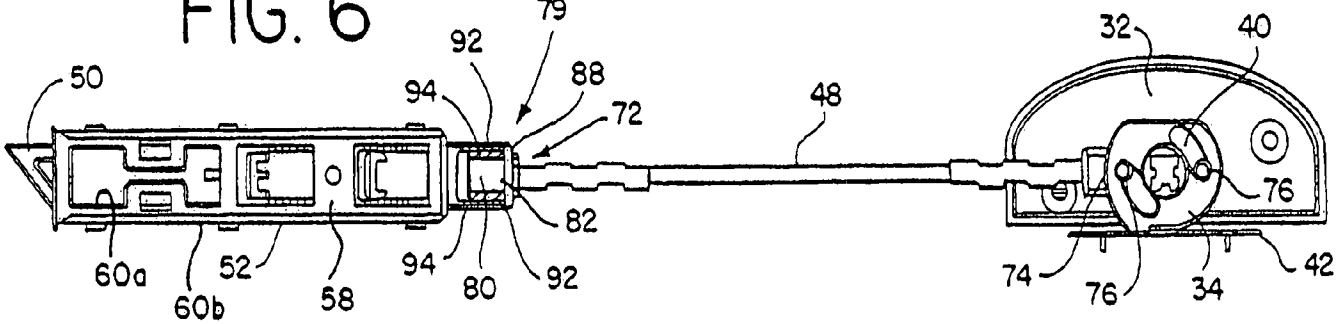
FIG. 6 is a bottom plan view illustrating the sash lock and tilt latch mechanisms of the integrated assembly of the present invention.
Figure 7:
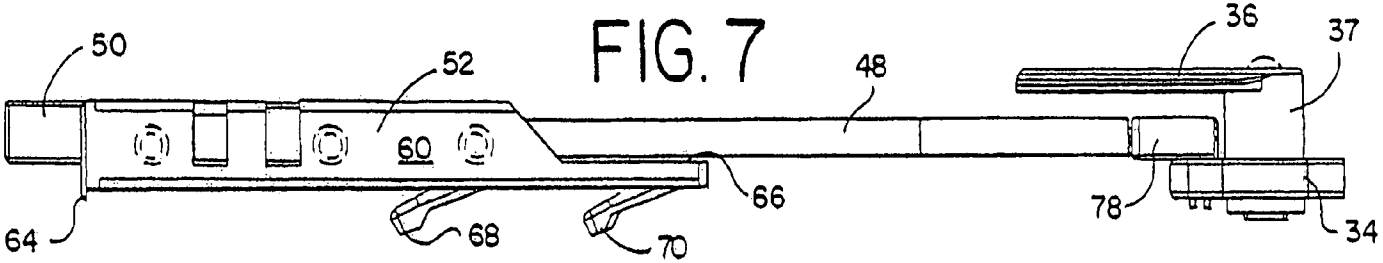
FIG. 7 is a side view illustrating another embodiment of the sash lock and tilt latch mechanisms of the integrated assembly of the present invention.

In one embodiment of the present invention shown in FIGS. 4-6, the connector 48 has a guide pin 76. The guide pin 76 is connected to the second end 74 of the connector 48 and slidably engages the slot 40 in the rotor 34. According to another embodiment illustrated in FIGS. 7-18, the connector 48 is coupled proximate a first end 72 to the latch bolt 50 and proximate a second end 74 to a first end of a linkage member 78*a*. The second end of the linkage member 78*b* is pivotably coupled to the rotor 34. The linkage member 78 is preferably curvilinear in shape such that a greater distance of travel is obtained from the first end of the linkage member 78*a* to the second end of the linkage member 78*b* as the linkage member 78 pivots about its second end 78*b*.

Figure 6A:
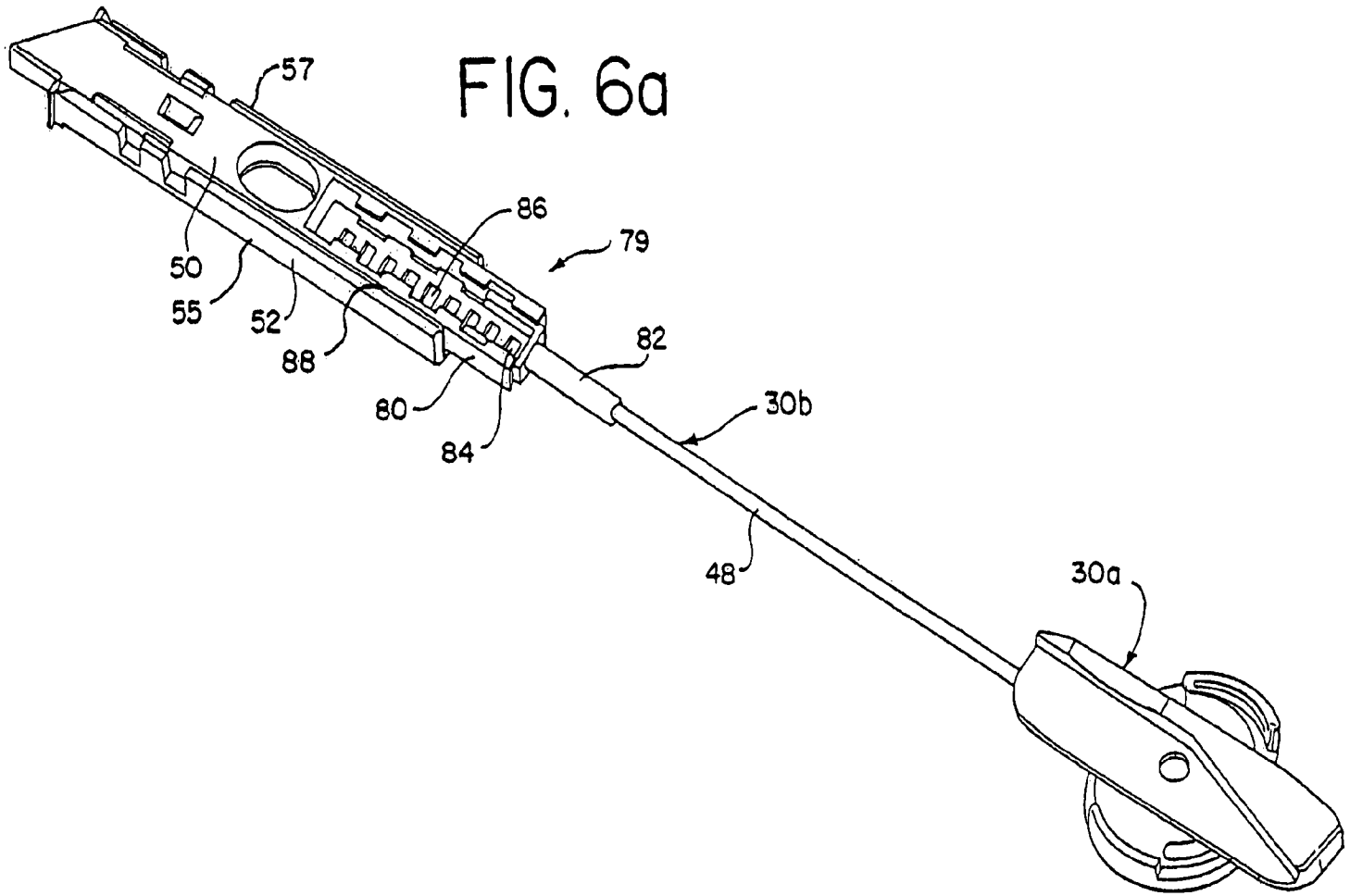
FIG. 6*a* is a perspective view of another embodiment of the integrated assembly of the present invention.

In one embodiment of the present invention in which a semi-rigid rod is employed as the connector 48, the connector 48 is a part of an adjustable connector assembly 79 as shown in FIGS. 3-6. As shown in FIG. 6*a*, the adjustable connector assembly 79 is comprised of an adjustable carrier 80 having a sleeve 82. The connector 48 is connected to the latch bolt 50 by the adjustable connector assembly 79. The position of the carrier 80 relative to the latch bolt housing 52 is adjustable to account for windows having different top sash rail lengths, to set the proper distance from the rotor 34 to the nose 56 of the latch bolt 50. The carrier 80 has holes 84, which receive sloped tabs 86. Thus, the housing 52 has a channel 88 formed by sidewalls 55 and shoulder portions 57. The carrier 80 is slid into the channel 88 to the proper position, where it is retained by the engagement of the holes 84 with the tabs 86.

The connector 48 may be secured to the sleeve 82 as by gluing. Alternatively, if a finer dimensional adjustment is necessary, the sleeve 82 and the corresponding end of the connector 48 can be cooperatively threaded. Thus, rotation of the connector 48 relative to the sleeve 82 further adjusts the distance from rotor 34 to the tip of the latch bolt 50.

As may be seen in FIGS. 4 and 6, the sidewall 60 of the latch bolt housing 52 has an inner sidewall 60*a* and an outer sidewall 60*b*, the inner sidewall 60*a* of the latch bolt housing 52, and at least a portion of a distal end of the adjustable carrier 80 has serrations 92. Thus, as the adjustable carrier 80 is slid into the channel 88, it is retained by the engagement of the serrations 92 of the adjustable carrier 80 with the complementary serrations 94 of the inner sidewall 60*a*. Thus, sliding the connector 48 and adjustable carrier 80 relative to the latch bolt housing 52 adjusts the distance from the rotor 34 to the latch bolt 50.

The embodiment in FIGS. 3-7 is considered a dual integrated assembly 30. As discussed, the rotor 34 has two slots 40. Thus, a connector 48 can be attached to each slot 40 wherein the sash lock mechanism 30*a* can actuate a pair of tilt-latch mechanisms 30*b* as described in greater detail below.

Figures 8, 9:
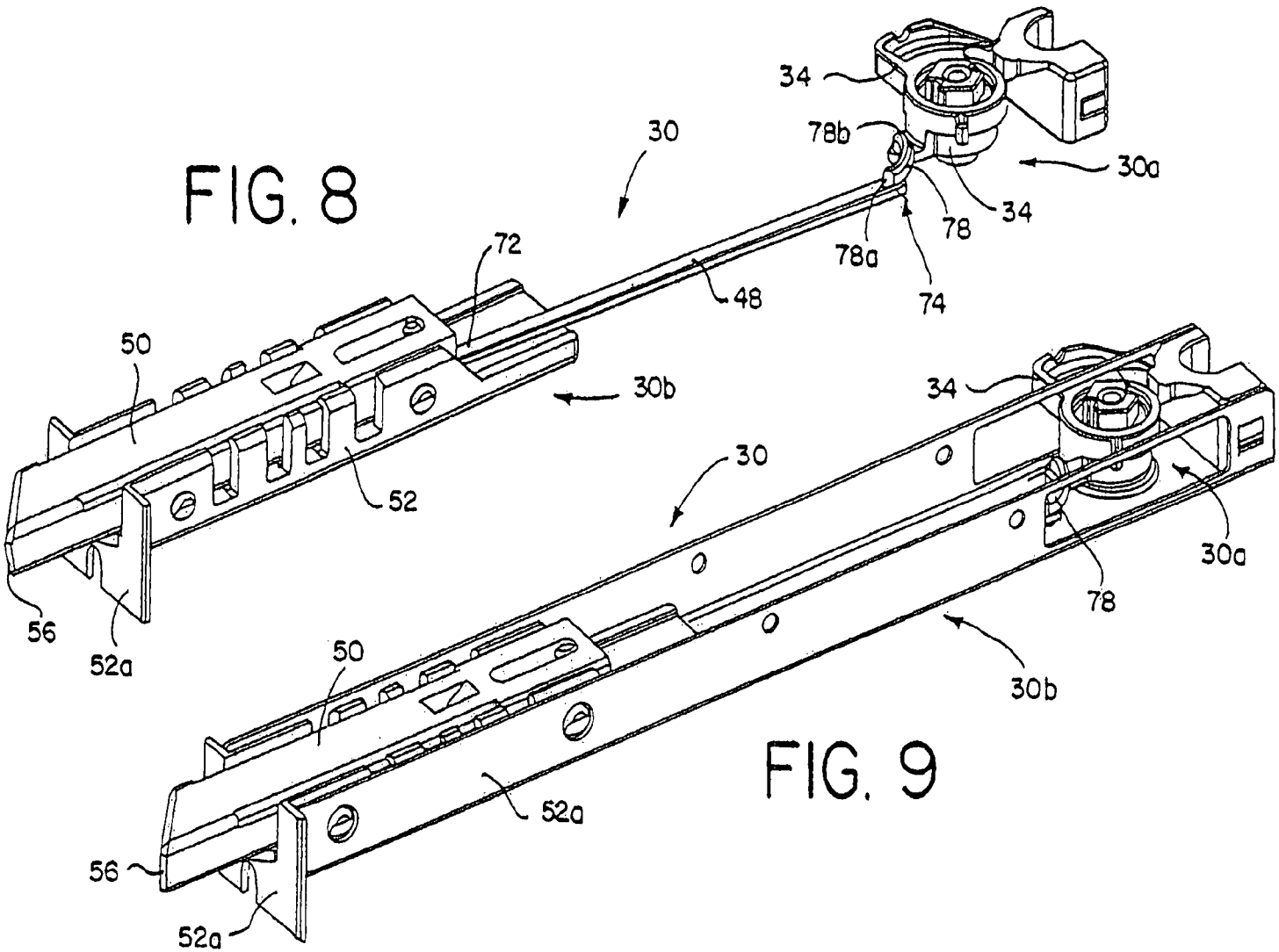
FIG. 8 is a partial perspective view of another embodiment of the integrated assembly of the present invention.
FIG. 9 is a perspective view of another embodiment of the integrated assembly of the present invention, and showing an alternative latch bolt housing and with a sash lock handle removed.
Figure 10:
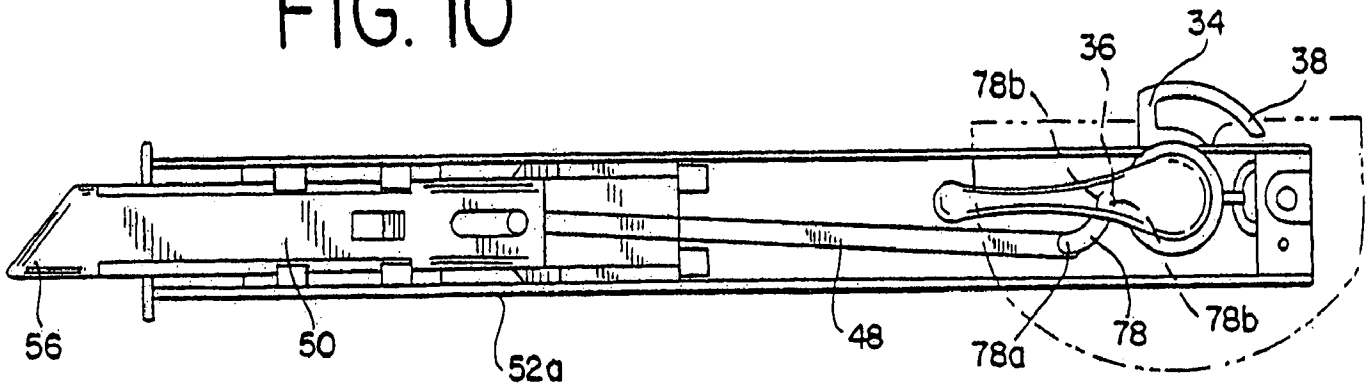
FIG. 10 is a top plan view of the integrated assembly of FIG. 9.
Figure 11:
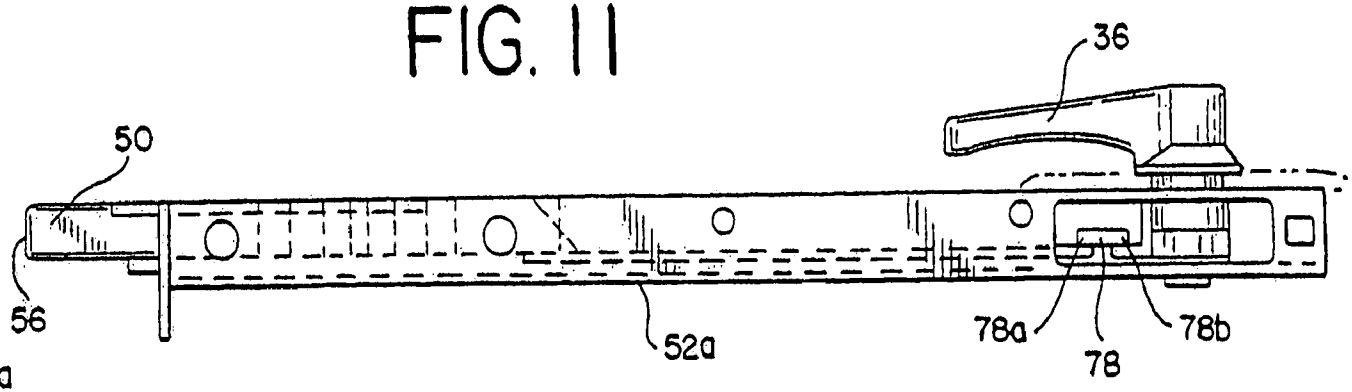
FIG. 11 is a side view of the integrated assembly of FIG. 9.
Figure 12:
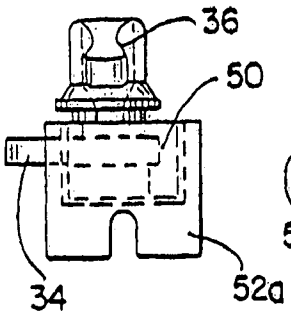
FIG. 12 is a end view of the integrated assembly of FIG. 9.
Figure 13:
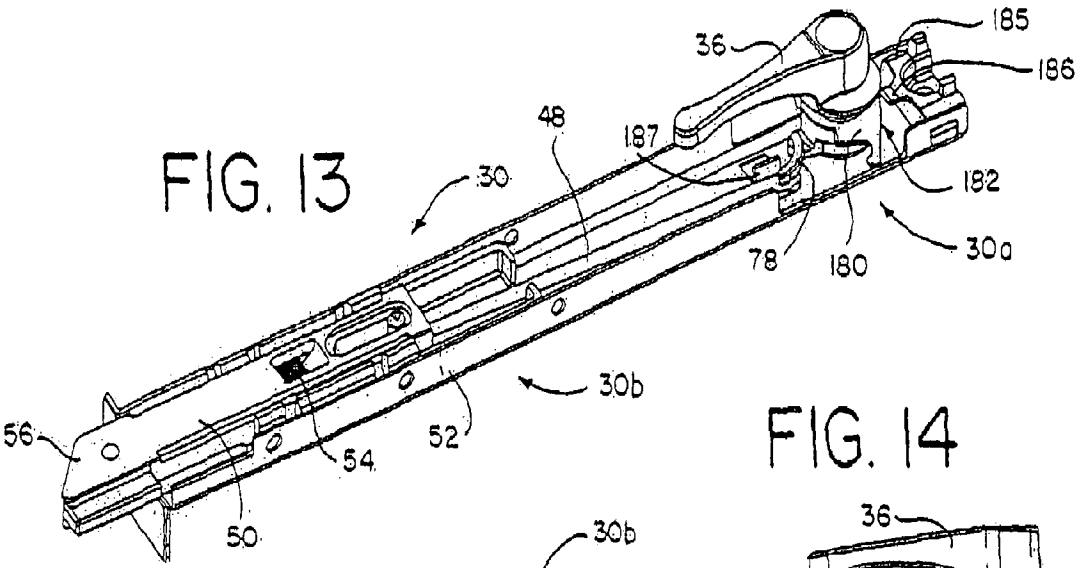
FIG. 13 is a perspective view of another embodiment of the integrated assembly of the present invention.
Figure 14:
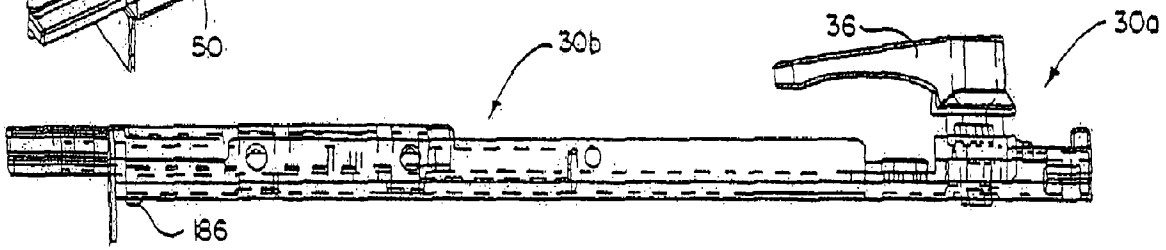
FIG. 14 is a side elevation view of the integrated assembly of FIG. 13.
Figure 15:
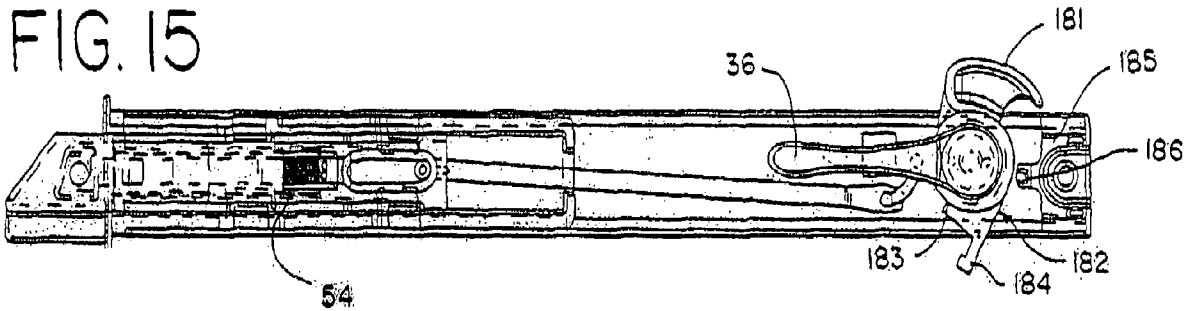
FIG. 15 is a top plan view of the integrated assembly of FIG. 13.

FIG. 8 discloses an embodiment of the integrated assembly 30 that is considered a single integrated assembly 30 wherein a single sash lock mechanism 30*a* cooperates with a single tilt-latch mechanism 30*b*. The connector 48 is coupled proximate the first end 72 to the latch bolt 50 and proximate a second end 74 to a first end 78*a* of the linkage member 78. The second end 78*b* of the linkage member 78 is pivotably coupled to the rotor 34. The linkage member 78 is preferably curvilinear in shape such that a greater distance of travel is obtained from the first end of the linkage member 78*a* to the second end of the linkage member 78*b* as the linkage member 78 pivots about its second end 78*b*. Thus, it can appreciated that the linkage member 78 can pivot about the second end 74 of the connector 48 and the rotor 34.

FIGS. 9-12 disclose another embodiment of the integrated assembly 30. In this embodiment, an alternative latch bolt housing 52*a* is utilized. The latch bolt housing 52*a* is a channel-like member that also houses the main components of the sash lock mechanism 30*a*.

FIGS. 13-18 disclose another embodiment of the integrated assembly 30 of the present invention. The embodiment of FIGS. 13-18 is similar to the embodiments shown in FIGS. 3-12 and similar elements will be designated with identical reference numerals. The sash lock mechanism 30*a* has a rotor 180 having a locking cam 181 and leg assembly 182. The leg assembly 182 has a projection 183 and a tab 184. The latch bolt housing 52 has a block assembly 185 having a well portion 186 that is adapted to receive the projection 183 when the assembly 30 is in the tiltable position as described in greater detail below. The tab 184 is adapted to abut the keeper 42 or the upper sash window 13 if an operator attempts to retract the latch bolt when the lower sash window 12 is in a closed position. This feature will also be described in greater detail below.

The latch bolt housing 52 further has an engaging member 186 depending from a bottom wall of the latch bolt housing 52. The engaging member 186 is adapted to engage an inside surface of the stile of the lower sash window 12 upon installation. This maintains the assembly 30 in the top rail 20 of the lower sash window. It is further understood that the assembly 30 is installed in the top rail 20 with the handle 36 rotated approximately 120 degrees wherein the extending portions of the rotor 180 are within the latch bolt housing. This allows the assembly 30 to fit into the opening of the top rail 20.

The latch bolt housing 52 further has a wall member 187 extending upwards from the bottom wall of the housing 52. The wall member 187 is positioned generally adjacent the linkage member 78 and the connected end of the connector 48. Because of the pivotal connections among the linkage member 78 and the connector 48 and the rotor 34, the wall member 187 maintains the connector 48 and linkage member 78 on an operational side 188 of the latch bolt housing 52. This wall member 187 prevents the linkage member 78 and connector 48 from moving towards the other side of the latch bolt housing 52 wherein the pivotal connections would be rendered inoperable. In a preferred embodiment, a portion of the bottom wall of the latch bolt housing 52 is cut and bent upwards to form the wall member 187. It is understood, however, that a separate wall member could be affixed to the bottom wall of the latch bolt housing 52.

Figure 16:
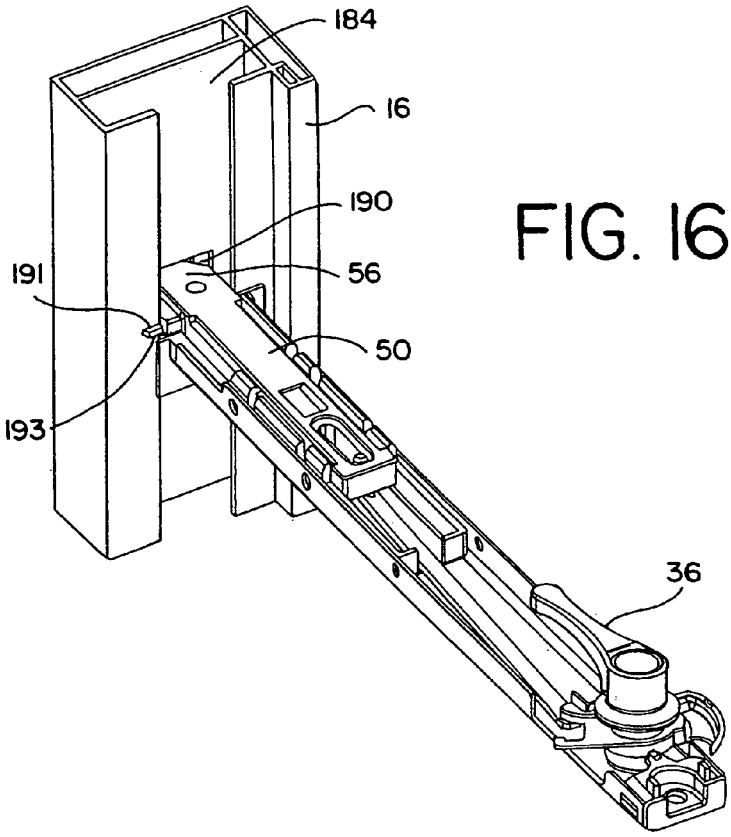
FIG. 16 is a perspective of the integrated assembly of FIG. 13 shown in cooperation with a portion of a guide rail of a master frame.
Figure 17:
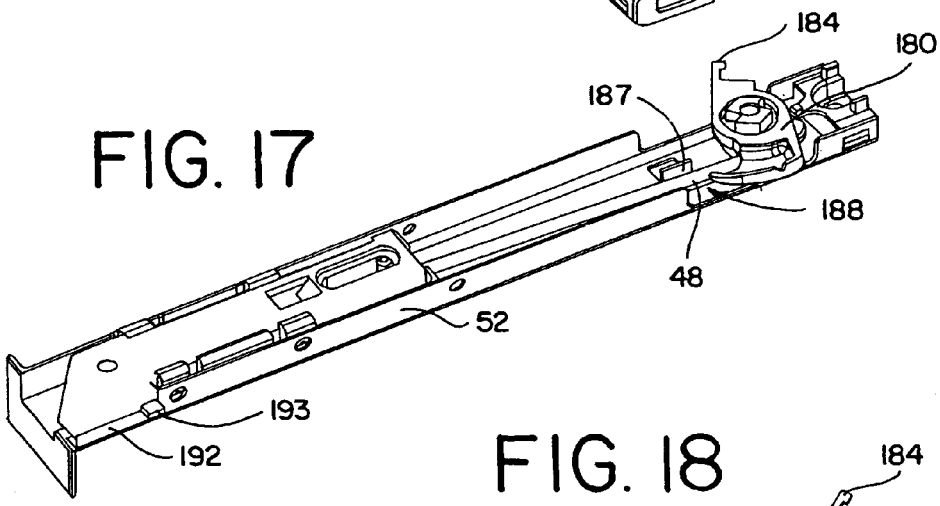
FIG. 17 is a perspective view of the integrated assembly of FIG. 13, shown in a retracted position.

As further shown in FIGS. 16 and 17, the window assembly 10 may have additional structures to selectively prevent sliding movement of the lower sash window 12 along the guide rails 16 of the master frame 14. As shown in FIG. 16, the guide rail 16 has a back wall 189 having an opening 190 therein. The opening 190 is vertically positioned on the guide rail 16 to correspond to the location of the latch bolt 50 when the lower sash window 12 is in a fully closed position. In the fully closed position, and the latch bolt 50 is dimensioned such that in the extended position, the nose 56 of the latch bolt 50 extends into the guide rail 16 and through the opening 190 in the back wall 189 of the guide rail 16. Engagement between the latch bolt nose 56 and the guide rail surfaces defined by the opening 190 prevents the lower sash window 12 from being raised, or bowed outwardly by external forces including wind forces or forced entry. The guide rail 16 further has a slot 191 therein, vertically positioned on the guide rail 16 proximate the location of the latch bolt 50 when the lower sash window 12 is in a fully closed position. The latch bolt nose 56 has a beveled portion 192 having a finger 193 extending therefrom. When the lower sash window 12 is in the fully closed position, the finger 193 is received by the slot 191. This cooperating structure provides further resistance to sliding of the lower sash window 12 in the guide rails 16. It is understood that in embodiments utilizing these cooperating structures, the sash lock mechanism 30*a* and the tilt-latch mechanism 30*b* are appropriately dimensioned such that the latch bolt 50 can be partially retracted wherein the finger 193 is removed from the slot 191 and the nose 56 is removed from the back wall opening 190 to allow the lower sash window 12 to be raised in order for the tab 184 to clear the keeper 42 when it is desired to place the integrated assembly in the tiltable position. The latch bolt 50, however, is not retracted enough at this initial retraction to clear the guide rail 16. Furthermore, if the lower sash window 12 remains in the closed position, further retraction will be prevented by the tab 184 engaging the keeper 42.

As shown in FIGS. 1-18, the integrated assembly 30 is generally supported by the top rail 20 of the lower sash window 12 and the base 22 of the upper sash window 13. With the exception of the keeper 42, all of the components of the integrated assembly 30 are mounted in and supported by the top rail 20 of the lower sash window 12. The keeper 42 is generally mounted on the base of the upper sash window. The top rail 20 has a generally hollow cavity to accommodate the a portion of the sash lock mechanism 30*a* and the tilt-latch mechanism 30*b*. The sash lock housing 32 may be mounted on a top surface of the top rail 20. The top rail 20 further has an opening to allow the handle 36 to be connected to the rotor 34. The tabs 68,70 of the latch bolt housing 52 are received by internal slots in the top rail 20. If the latch bolt housing 50 is used without the tabs 68,70, the design utilizing the engaging member 186 may be used.

As discussed, the integrated assembly 30 is operable among three positions: a first position corresponding to the locked position, a second position corresponding to the unlocked position and a third position corresponding to the tiltable position. The handle 36 of the sash lock mechanism 30*a* is actuated by an operator to place the integrated assembly 30 in these various positions. In one embodiment of the present invention, the handle 36 and the upper side of the rotor 34 include cooperating structures, such that the integrated assembly 30 produces an audible click, whenever the handle 36 reaches any of the locked, unlocked or released positions.

As discussed briefly above, the sash lock operations are performed by the sash lock mechanism 30*a* of the integrated assembly 30, and the tilt-latch operations are performed by the tilt-latch mechanism 30*b* of the integrated assembly 30 with actuation by the sash lock mechanism 30*a*. As can be understood from FIGS. 1 and 2, when the integrated assembly 30 is in the locked position, the lower sash window 12 is fully lowered in the master frame 14 and the upper sash window 13 is fully raised in the master frame 14. The rotor 34 engages the keeper 42 and the latch bolts 50 are in an extended position to engage the guide rails 16 of the master frame 14. Thus the lower sash window 12 is prevented from vertically opening and from tilting.

When an operator rotates the handle 36 to a first angle a from the locked position (FIG. 3), the integrated assembly 30 is placed in the unlocked position. In the unlocked position, the handle 36 rotates the rotor 34 such that the locking end 38 of the rotor 34 disengages from the keeper 42. With no engagement between the rotor 34 and the keeper 42, the lower sash window 12 is permitted to vertically open. However, the guide pin 76 slides along its respective slot 40 and thus the latch bolt 50 remains outwardly extended into the guide rails 16 Thus, the lower sash window 12 continues to be prevented from tilting.

When an operator further rotates the handle 36 to a second angle β from the locked position (FIG. 3), the integrated assembly 30 is moved from the unlocked position to the tiltable position. The second angle β is greater than the first angle α. In the tiltable position, the handle 36 is further rotated wherein the rotor 34 remains disengaged from the keeper 42, still permitting the lower sash window 12 to vertically open. In addition, the guide pin 76 abuttingly engages the end of rotor slot 40 such that as the rotor 34 is further rotated by the handle 36, the connector 48 pulls the latch bolt 50 to inwardly retract the latch bolt 50 into the latch bolt housing 52 and, therefore, into the top rail 20. Accordingly, the latch bolt 50 is released from the guide rail 16 thereby allowing the lower sash window 12 to be tilted inwardly.

Figure 18:
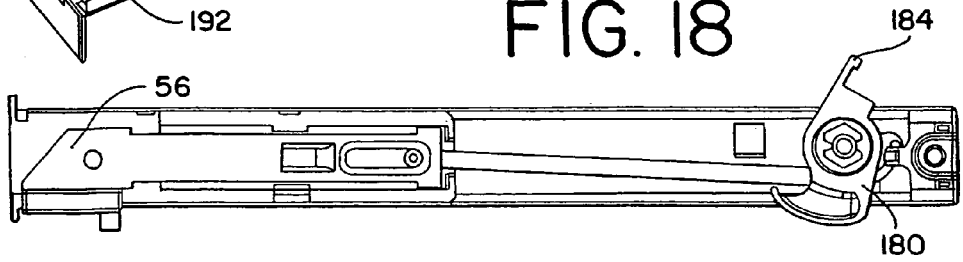
FIG. 18 is a top plan view of the integrated assembly of FIG. 13, shown in the retracted position.

In the embodiment shown in FIGS. 13-18, the rotor 180 has structure to selectively prevent retraction of the latch bolt 50. If the lower sash window 12 is in the fully closed position and an operator attempts to rotate the handle 36 from the unlocked position to the tiltable position, the tab 184 on the leg assembly 182 will engage the keeper 42 or other part of the upper sash window 13. This engagement will prevent further rotation of the handle 36 and thus retraction of the latch bolt 50. Thus, in order to retract the latch bolt 50, the lower sash window 12 must be raised slightly to wherein the leg will clear the keeper 42. This prevents inadvertent retraction of the latch bolt 50. To place the integrated assembly 30 in the tiltable position, the lower sash window 12 is raised slightly so that the tab 184 will clear the keeper 42 and allow full rotation of the handle 36. As discussed, it is understood that the sash lock mechanism 30*a* and tilt-latch mechanism 30*b*, in embodiments using these cooperating structures, will allow the latch bolt 50 to be partially retracted to allow lower sash window 12 to be raised to provide for needed clearance. FIGS. 17-18 disclose the integrated assembly 30 in the tiltable position wherein the latch bolt 50 is in a retracted position. When the actuator 36 is placed in the tiltable position and the latch bolt 50 is retracted, the projection 183 is received by and maintained in the well portion 186. This maintains the latch bolt 50 in a retracted position if desired. The projection 183 has adequate resiliency to be moved in and out of the well portion 186 upon rotation of the rotor 180 by the handle 36.

When operating the handle 36 in reverse to the above, the handle 36 is moved from the tiltable position to the unlocked position, and the rotor 34 is rotated back to the first angle α. The locking cam 44 remains disengaged from the keeper 42, still permitting the sash window to vertically open. However, the guide pin 76 no longer engages the end of the slot 40, and the biasing means 54 biases the latch bolt 50 outwardly into the guide rails 16. Thus, the sash window is prevented from tilting.

When the handle 36 is moved from the unlocked position to the locked position. The locking cam 44 engages the keeper 42, preventing the sash window from opening. The guide pin 76 engages the opposed end of the rotor slot 40, and holds the latch bolt 50 in its extended position. Thus, the sash window is still prevented from tilting, and the latch bolt 50 provides additional security against opening of the window.

As discussed in further detail below, the handle 36 can include a plurality of indicia to indicate to an operator certain operating positions of the integrated assembly 30.

As shown in FIG. 1, it is understood that a single integrated assembly 30 can be employed on opposite sides of the top rail 20 of the lower sash window 12. The construction, installation and operation of the integrated assemblies 30 are generally identical and configured appropriately for each side of the top rail 20. As can be understood from FIGS. 2 and 3, a single sash lock mechanism 30*a* can be employed to operate a pair of tilt-latch mechanisms 30*b* on opposite sides of the top rail 20, sometimes referred to as a dual integrated assembly. For example, the rotor 34 in FIG. 3 has a pair of slots 40. Each slot 40 receives a respective connector 48 of the pair of tilt-latch mechanisms 30*b* employed.

Another embodiment of the present invention is illustrated in FIGS. 19-40. According to this embodiment, the sash window assembly 10 includes an integrated tilt/sash lock assembly 130. For ease of description, this will hereinafter be referred to as the integrated assembly 130. As with the above described embodiments, the integrated assembly 130 of this embodiment generally includes a sash lock mechanism 130*a* and a tilt-latch mechanism 130*b*. The sash lock mechanism 130*a* provides a sash locking operation the tilt-latch mechanism 130*b* provides a tilt-latch operation. While the integrated assembly 130 will be described herein with respect to a dual integrated assembly wherein a single sash lock mechanism actuates a pair of latch bolts, the integrated assembly could also be constructed as a single integrated assembly wherein a single sash lock mechanism actuates a single latch bolt. In the case of the dual integrated assembly, an additional sash lock mechanism could be added. However, the second sash lock mechanism would only perform a sash lock operation and not a tilt-latch operation.

The sash lock mechanism 130*a* will first be described followed by a description of the tilt-latch mechanism 130*b* of the integrated assembly 130. The interaction between the sash lock mechanism 130*a* and the tilt-latch mechanism 130*b* will further be described in greater detail below.

FIGS. 23-31 illustrate one embodiment of the sash lock mechanism 130a according to the present invention. The sash lock mechanism 130*a* of the integrated assembly 130 generally includes a sash lock system 131 and a keeper 142.

As shown in FIGS. 23-26, the sash lock system 131 generally includes a rotor assembly 133, a rotor assembly housing 135 and an actuator or handle 136. The handle 136 of this embodiment of the integrated assembly 130 is operably coupled to the rotor assembly 133. As was described in the previous embodiment, the handle 136 is generally operable among three positions: the locked position, the unlocked position and the tiltable position.

The rotor assembly housing 135 generally houses the rotor assembly 133. The housing 135 is mounted on a top surface of the top rail 20 of the lower sash window 12. The housing 135 has an opening to receive the handle 136 for connection to the rotor assembly 133.

Figure 29:
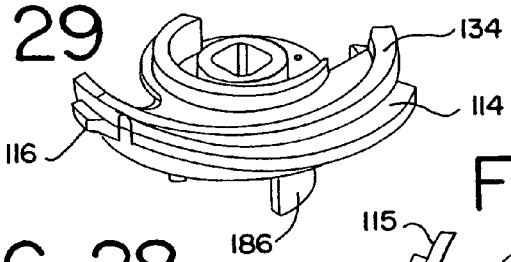
FIG. 29 is a perspective view illustrating a cam used in connection with the integrated assembly of FIG. 19.
Figure 30:
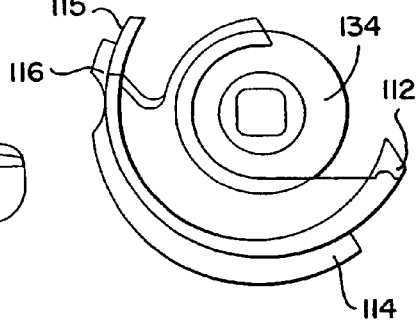
FIG. 30 is a top view illustrating the cam of FIG. 29.
Figure 31:
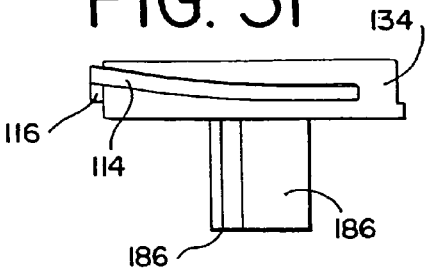
FIG. 31 is a front elevation view illustrating the cam of FIG. 29.

The rotor assembly 133 generally includes a cam 134. As best seen in FIGS. 29-31, the cam 134 of the rotor assembly 133 is comprised of a locking end 115 and an abutting end 112. The cam 134 further also includes a first flange 114 and a second flange 116. The first flange 114 traverses a first portion of the cam 134 proximate the abutting end 112 and is upwardly canted toward the locking end 115. The second flange 116 traverses a second portion of the cam 134 and is vertically spaced from the first flange 114. The paths of traverse of the first flange 114 and the second flange 116 do not overlap.

The button 108 is disposed proximate the handle 136 and is upwardly biased by a spring 118. As will be described in greater detail below, the button 108 provides a means for preventing the handle 136 from being rotated from the unlocked position to the tiltable position. According to the present invention, the button 108 is depressable and comprises a top portion 120 and a bottom portion 122. The bottom portion 122 of the button 108 includes a groove 124 therein which is adapted to cooperatively engage the flanges 114, 116. The operation of the button 108 relative to the cam 134 will be described in more detail below.

Figure 19:
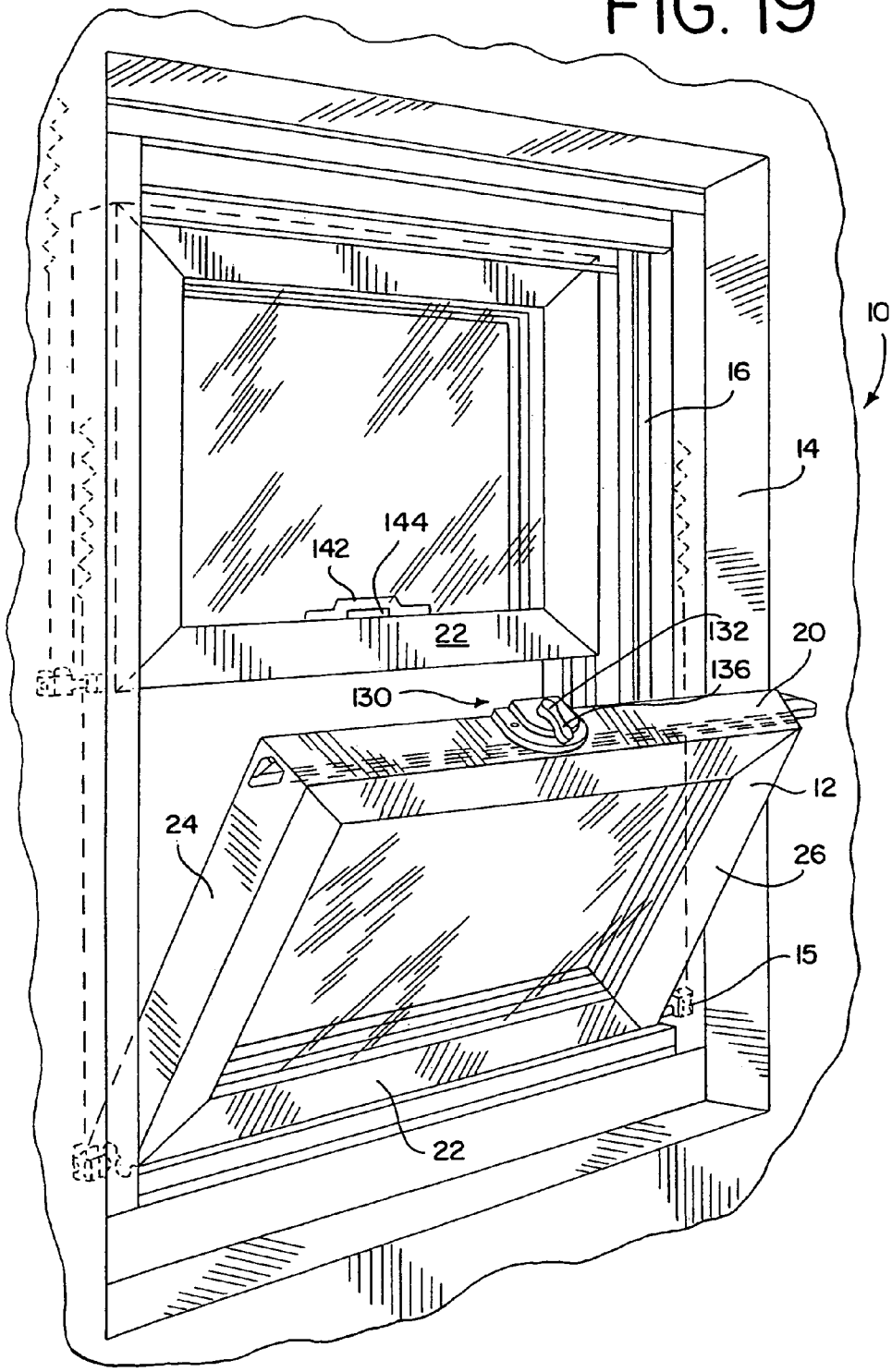
FIG. 19 a perspective view of a sash window assembly incorporating another embodiment of an integrated tilt/sash lock assembly of the present invention.
Figure 20:
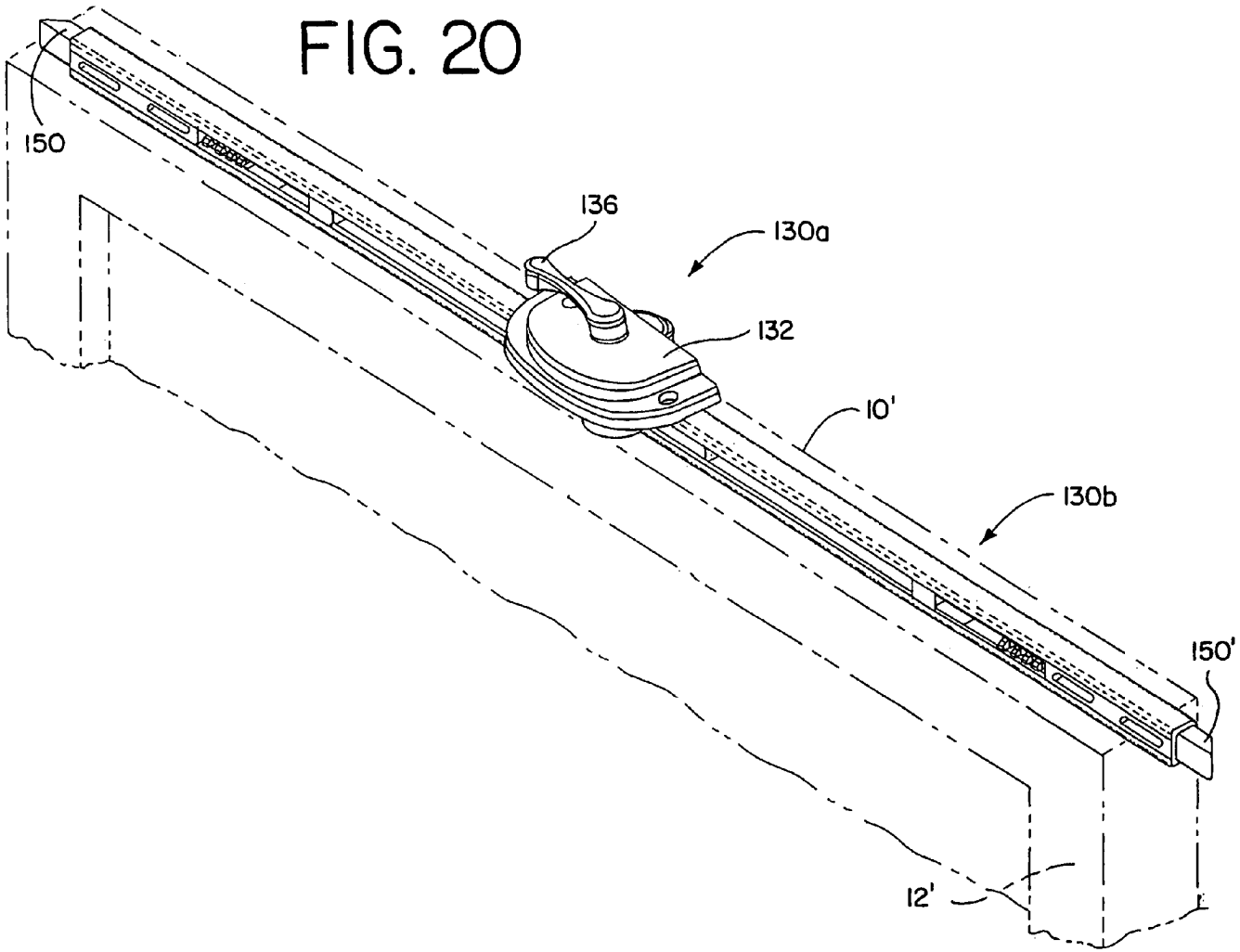
FIG. 20 a perspective view of the integrated assembly of FIG. 19 with a portion of a lower sash window shown in phantom.

As shown in FIG. 19, the keeper 142 of the sash lock mechanism is generally a bracketed structure having an opening 144 adapted to receive the locking end 138 of the cam 134. The keeper 142 can be made of any material suitable for the applications described herein. The keeper 142 is disposed on the base of the upper sash window adjacent the sash lock system 131. When the sash window is in a closed position, the keeper 142 and sash lock system 131 are substantially aligned.

Figures 21, 22:
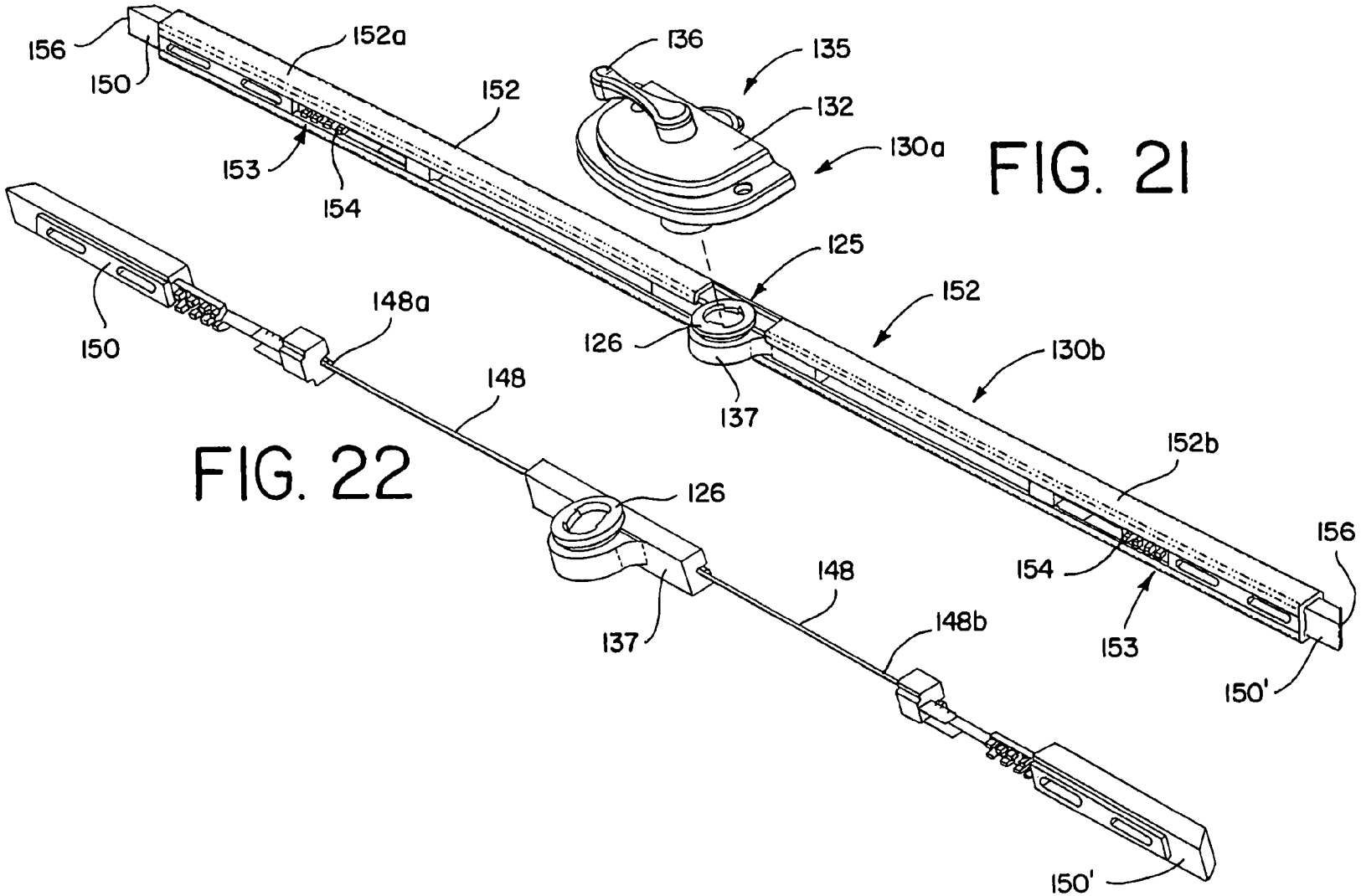
FIG. 21 is a partially exploded perspective view illustrating the sash lock and tilt latch mechanisms of the integrated assembly of FIG. 20.
FIG. 22 is a partial perspective view of the integrated assembly of FIG. 19.

The tilt-latch mechanism 130*b* is generally shown in FIGS. 21 and 22. The tilt-latch operation of the integrated assembly 130 is generally carried out by the handle 136 actuating the tilt-latch mechanism 130*b*. The tilt-latch mechanism 130*b* generally includes a latch bolt assembly and a connector 148. The latch bolt assembly includes a first latch bolt 150, a second latch bolt 150', a sleeve 152, a spool assembly 126 and a pair of biasing means 153.

The first and second latch bolts 150, 150' each have a first end, a second end. Further, each latch bolt 150, 150' has a nose 156 extending from a first end which is adapted for engaging a respective one of the guide rails 16 of the master frame 14. The first and second latch bolts 150, 150' are each slidably disposed proximate opposed ends of the sleeve 152. Thus, the sleeve 152 defines a latch bolt housing for slidably securing the latch bolts 150, 150' in the integrated assembly 130. According to one embodiment of the present invention, the sleeve 152 comprises a first portion 152*a* and a second portion 152*b* that are slidably connected one to the other. Alternatively, as shown in FIG. 21, the first and second portions 152*a*, 152*b* are connected to the spool support member 137. The latch bolt system further includes a means for outwardly biasing the latch bolts 150, 150' toward respective the guide rails. Generally, the means for outwardly biasing the latch bolts 150, 150' is a spring 154. It should be noted that the means for biasing 153 the latch bolts 150, 151' should not be limited to springs. The means 154 may be a pressure activated mechanism, a cam, a compressed material with resilient characteristics or any other mechanisms suitable for outwardly biasing the latch bolts 150, 150'.

As further shown in FIGS. 21 and 22, the connector 148 having a first end 148a and an opposed second end 148*b*. The first end of the connector 148*a* is coupled to the first latch bolt 150 and the opposed second end of the connector 148*b* is coupled to the second latch bolt 150'. A portion of the connector 148 is operably coupled with the rotor assembly 133. The flexible connector 148 of this embodiment of the present invention is preferably a flexible cord. It is also contemplated, however, that a chain or wire be employed as a connector 148 without departing from the present invention.

As shown in FIGS. 21, 22 and 32-36, the spool assembly 125 generally includes a spool 126 and a spool housing 137 or spool support member 137. FIGS. 32 and 33 show the spool 126. The spool 126 has an end wall 128 and a sidewall 129 depending from the end wall 128. The spool 126 receives a portion of the cam 134. The end wall 128 of the spool 126 includes a throughway 147 which, in turn, includes at least one keyway 127. While the embodiments shown depict two keyways 127 in the end wall 128 of the spool 126, it is contemplated that the spool 126 may include any number of keyways 127 suitable for performing the cooperative function described below. The sidewall 129 of the spool 126 has a slot 107 disposed therein. According to this embodiment, a first surface of the cam 134 is coupled to the handle 136, and a second surface of the cam 134 is adapted to operatively engage the keyways 127 of the spool 126. According to one embodiment of the invention, the cam 134 includes engaging tabs 186 which cooperate with the keyways 127. The spool 126 is received in a spool support member 137. The spool support member 137 has a central opening adapted to receive the spool 126. The connector 148 passes through the spool support member 137.

As shown in FIG. 32, in one embodiment of the present invention incorporating the spool 126 described above, the connector 148 passes into and out of the slot 107 in the spool 126. The connector 148 forms a loop within the spool 126 and is secured therein by a plug or fastener 178. The plug or fastener 178 is shown in greater detail in FIG. 34. The fastener 178 has a plurality of tabs 186 which fit into an opening 167 in the spool 126 and engage the spool 126 to fasten the connector 148 to the spool 126. The fastener 178 further has a plurality of serrated teeth 179 that cooperate with corresponding serrated teeth 169 on the spool 126.

According to another embodiment shown in FIG. 33, the spool 126 has a hook 176 extending from the sidewall 129 of the spool 126. In this embodiment, the connector 148 loops around the hook 176. According to either of the above embodiments, the length of one end of the connector 148 as measured from the spool 126 must be greater than the opposed length of the connector 148 in order to ensure proper actuation of the latch bolts when moving the integrated assembly 130 to a tiltable position as described below.

Figure 37:
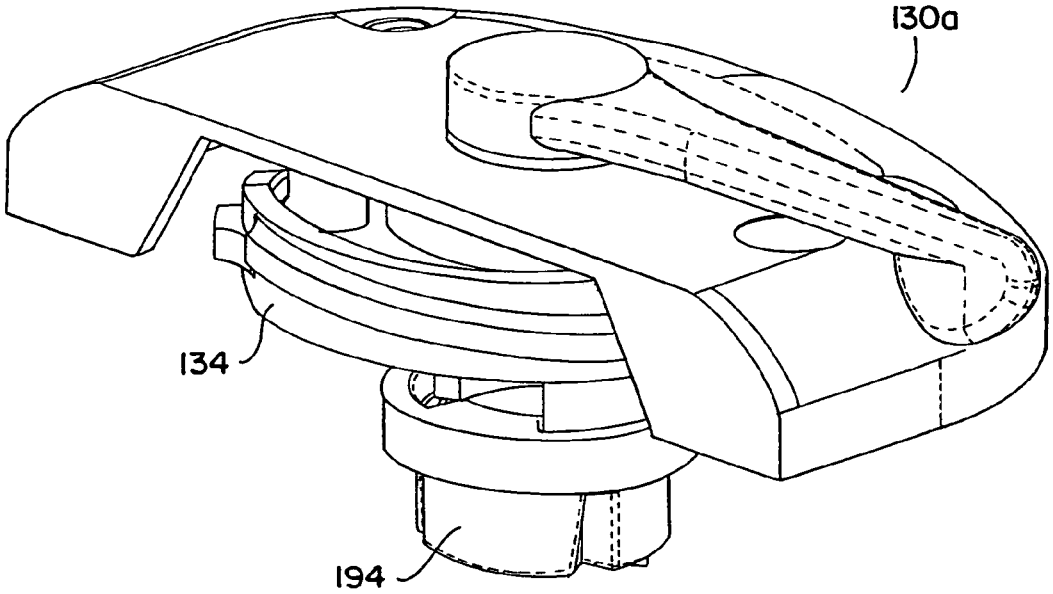
FIG. 37 is a perspective view of a portion of the sash lock mechanism shown in FIG. 23 and having an alternative embodiment of the spool.
Figure 38:
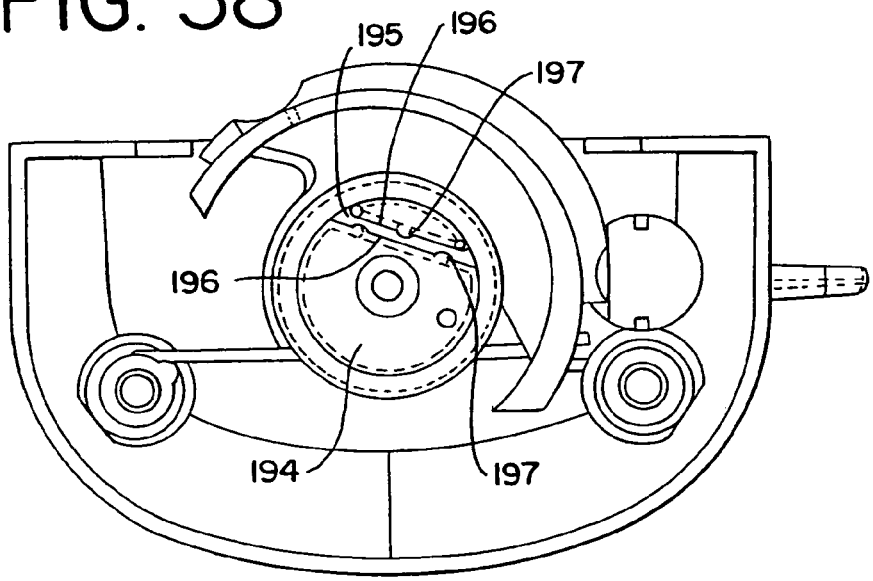
FIG. 38 is a bottom plan view of the portion of the sash lock mechanism shown in FIG. 37.
Figure 39:
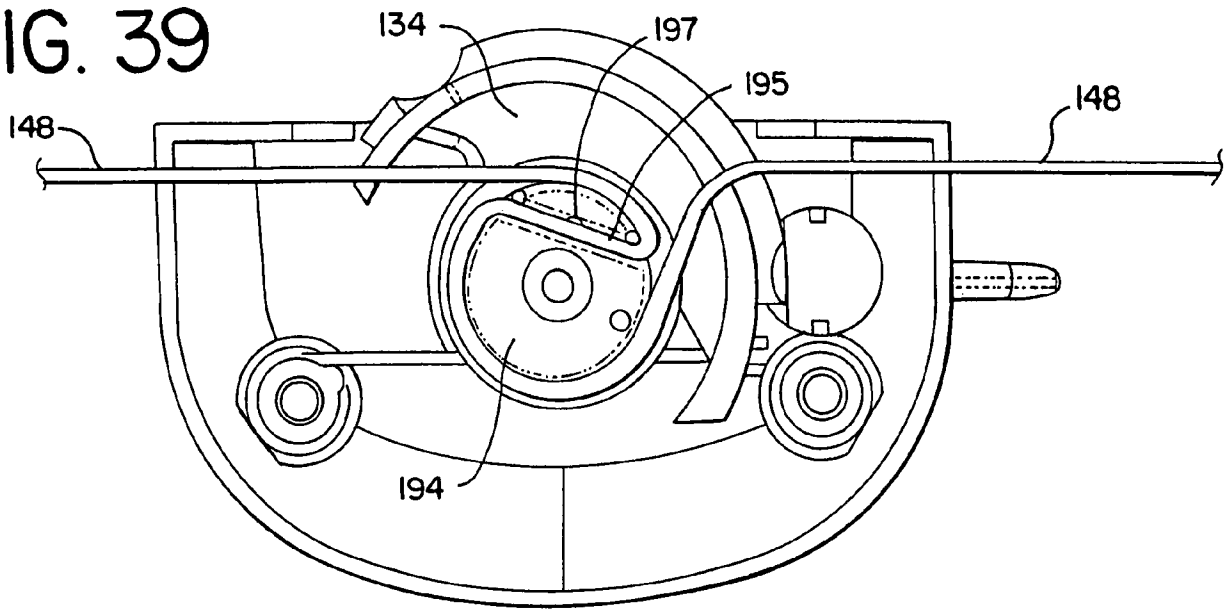
FIG. 39 is a bottom plan view of the portion of the sash lock mechanism shown in FIG. 37 and having a connector connected to the spool.
Figure 40:
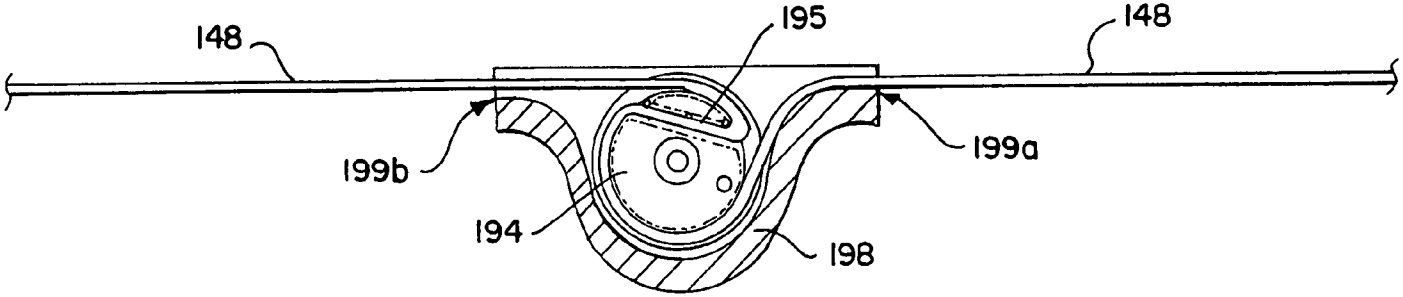
FIG. 40 is a bottom plan view of the spool and connector shown in FIG. 39 and received by an alternative embodiment of the spool housing.

FIGS. 37-40 disclose an alternative embodiment of the spool and spool housing. FIG. 37 discloses a portion of the sash lock mechanism 130*a* wherein a spool 194 is connected to the rotor 134 as described above. The spool 194 has a generally annular shape. As shown in FIG. 38, the spool 194 has a passageway or channel 195. The channel 195 is spaced from a center of the spool 194 and generally occupies a cord of the spool 194. The channel 195 is not a radial or diametrically passageway. The channel 195 is defined by a pair of spaced internal walls 196 of the spool 194. The internal walls 196 have a plurality of spaced protrusions 197. As shown in FIGS. 39 and 40, the connector 148 is routed around the spool 194 and through the channel 195. The protrusions 197 assist in gripping the connector 148. As shown in FIG. 40, an alternative embodiment of a spool housing 198 receives the spool 194 and the connector 148. The spool housing 198 has a first end 199*a* and a second end 199*b*. Because of the routing of the connector 148 in the spool 194, the connector 148 does not contact the second end 199*b* of the spool housing 198. Thus, the second end 199*b* of the spool housing 198 does not guide the connector 148. As can be understood, when the handle 136 is rotated to rotate both the cam 134 and spool 194, the connector 148 is pulled to retract the latch bolts 150 into the latch bolt housing 152.

The operation of the integrated assembly 130 will now be described in detail. As discussed above, the handle 136 of the present invention is operable among three positions: the locked position, the unlocked position and the tiltable position. When the sash windows are in the locked position, the cam 134 engages the keeper 142 and the latch bolts 150, 150' are fully, outwardly extended to engage the guide rails 16. Thus the sash window 12 is prevented from vertically opening and from tilting. Also, in the locked position, the groove 124 of the button 108 is in operable engagement with the first flange 114, and the top portion 120 of the button 108 is fully retracted in the sash lock housing 135.

Figure 23:
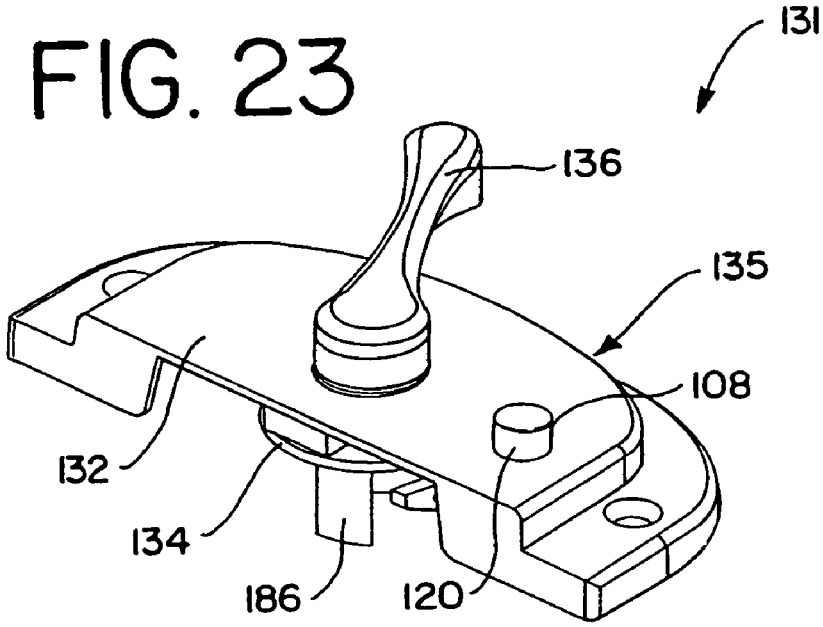
FIG. 23 is a top perspective view illustrating a portion of a sash lock mechanism of the integrated assembly of FIG. 19.
Figure 24:
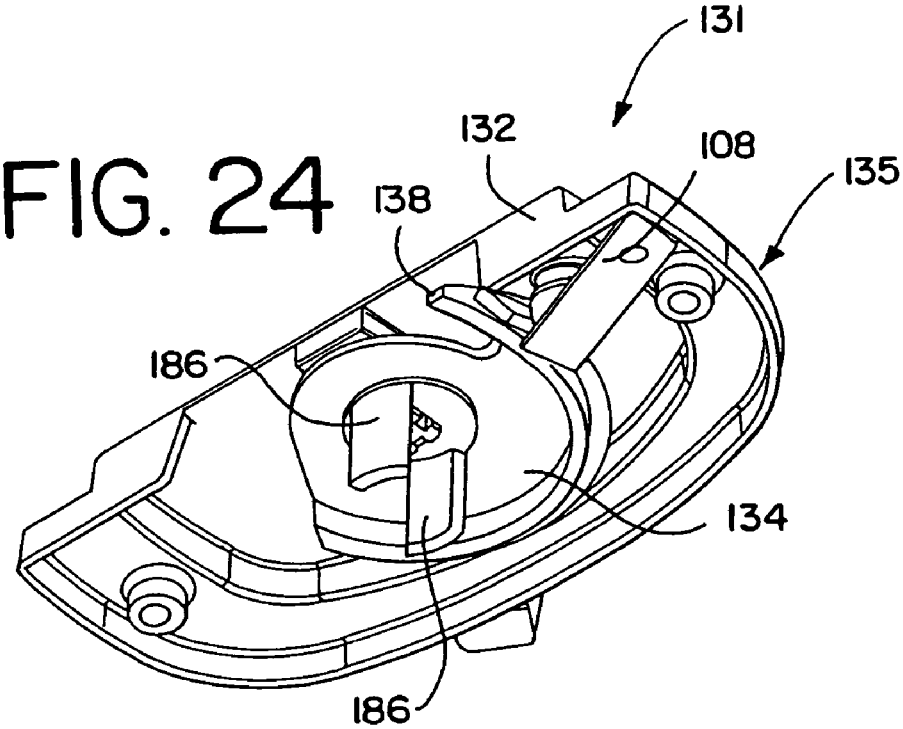
FIG. 24 is a bottom perspective view illustrating the portion of the sash lock mechanism of FIG. 23.
Figure 27:
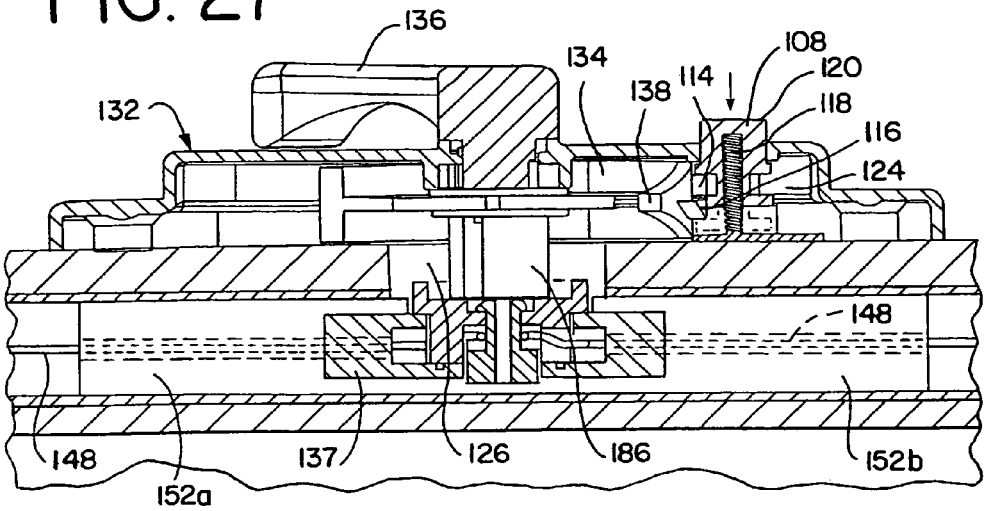
FIG. 27 is a cross-sectional view of the sash lock mechanism of the integrated assembly of FIG. 19, the sash lock mechanism being attached to a connector of a tilt-latch mechanism.
Figure 28:
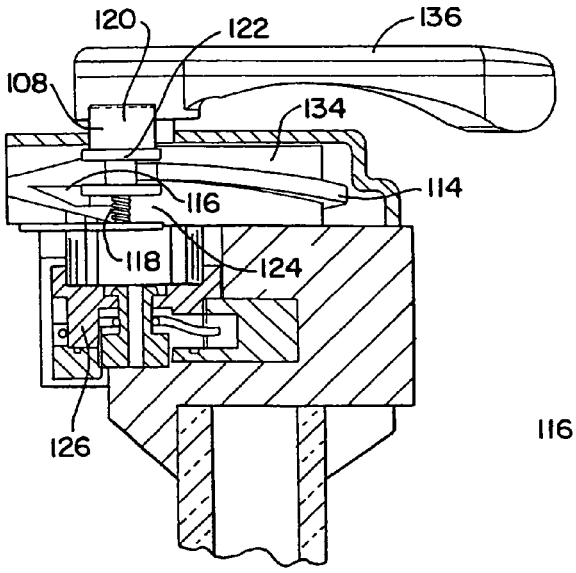
FIG. 28 is a cross-sectional view of the sash lock mechanism of FIG. 19.

When the handle 136 is moved from the locked position to the unlocked position, the cam 134 is rotated to a first angle from the locked position. This can be considered a 60 degree rotation of the handle 136. This rotation disengages the locking end 138 of the cam 134 from the keeper 142, permitting the sash window 12 to vertically open. However, the tabs 186 of the cam 134 are not yet abutting an inner surface of the keyways 127 on the spool. Thus, the tilt latch bolts 150, 150' remain outwardly extended into the guide rail 16. Thus, the lower sash window 12 continues to be prevented from tilting. As the handle 136 is moved from the locked position to the unlocked position, the groove 124 of the button 108 slides along the first flange 114 which extends the button out of the sash lock housing 135. When the handle 136 continues to be rotated in the unlocked position, generally considered from the 60 degree rotation moving towards a 120 degree rotation, the latch bolts 150,150' are partially retracted. At the 120 degree rotational position, the bottom of the button 108 abuts the second flange 116, thereby obstructing further movement of the handle 136 and rotation of the cam 134. This configuration is generally shown in FIGS. 23 and 28 wherein the handle 136 is rotated to the 120 degree rotational position. This prevents inadvertent retraction of the latch bolts 150, 150;. Thus, this configuration provides a means for preventing the handle 136 from being moved from the unlocked position to the tiltable position. More specifically, in this position, the top of the button 108 is fully upwardly biased. In order to further move the handle 136 from the unlocked position to the tiltable position, the button 108 must be depressed. Depressing the button 108 causes the groove 124 of the button 108 to be aligned with and engage the second flange 116 of the cam 134. With the second flange 116 aligned with the groove 124, the cam 134 can be further rotated by the handle 136.

When the handle 136 is moved from the unlocked position to the tiltable position, the cam 134 is rotated a second angle from the locked position. This can be considered rotation from the 120 degree rotational position to the 180 degree rotational position. In the tiltable position, the locking end 138 of the cam 134 remains disengaged from the keeper 142, still permitting the sash window to vertically open. However, the tabs 186 extending from the cam 134 engage abutting inner surfaces of the keyways 127 as the cam 134 is rotated. This abutment rotates the spool 126 which, in turn, pulls the connector 148 so that the tilt latch bolts 150,150' are inwardly retracted and released from the guide rail 16. Thus, the sash window 12 is permitted to tilt.

When operating the handle 136 in reverse to the above, the handle 136 is moved from the tiltable position to the unlocked position, and the cam 134 is rotated back to the first angle. The rotor assembly 133 may also include a handle spring that assists in returning the handle 136 from a 180 degree position to a 120 degree position. When the handle 136 is moved from the unlocked position to the locked position. The locking end 138 engages the keeper 142, preventing the sash window 10 from opening. Thus, the sash window 10 is still prevented from tilting, and the tilt latch bolts 150, 150' provide additional security against opening of the window.

As the handle 136 is moved from the tiltable position to the unlocked position, the groove 124 of the button 108 re-engages a ramped portion of the second flange 116. When the handle 136 reaches the unlocked position, the spring 154 cooperating with the button 108 biases the button 108 upward, such that the groove 124 is aligned with the first flange 114. As the handle 136 is moved toward the locked position, the groove 124 re-engages the first flange 114 and draws the top of the button 108 downward into the sash lock housing 135.

Yet another embodiment of the present invention is illustrated in FIGS. 41-58. It is contemplated that the embodiment of FIGS. 41-58 is preferably utilized in a sash window assembly 10 made from wood such as shown in FIG. 31. The wooden sash window assembly 10 shown in FIG. 41 has a similar construction to the sash window assemblies disclosed in FIGS. 1, 2 and 19. It is further understood that the embodiment of FIGS. 41-58 can also be utilized in other sash window assemblies made from other materials such as vinyl.

According to this embodiment, a sash window assembly includes an integrated tilt/sash lock assembly 230. For ease of description, this will hereinafter be referred to as the integrated assembly 230. As with the above described embodiments, the integrated assembly 230 of this embodiment provides a sash locking operation and a tilt latch operation. While the integrated assembly 230 will be described herein with respect to a single integrated assembly 230, the integrated assembly 230 can also be used in connection with a dual integrated assembly.

Figure 42:
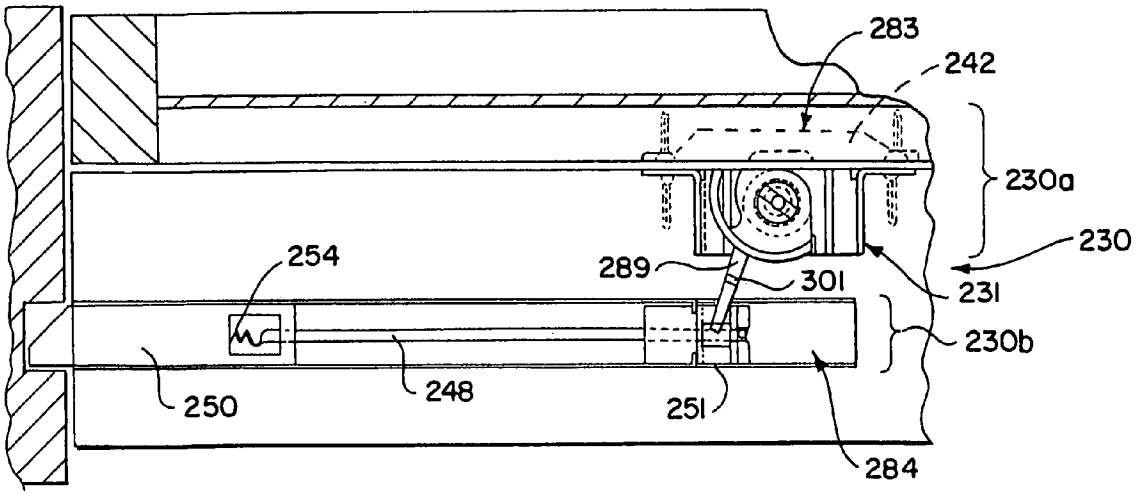
FIG. 42 is a partial top cross-sectional plan view of a sash window assembly incorporating another embodiment of an integrated tilt/sash lock assembly of the present invention.
Figure 43:
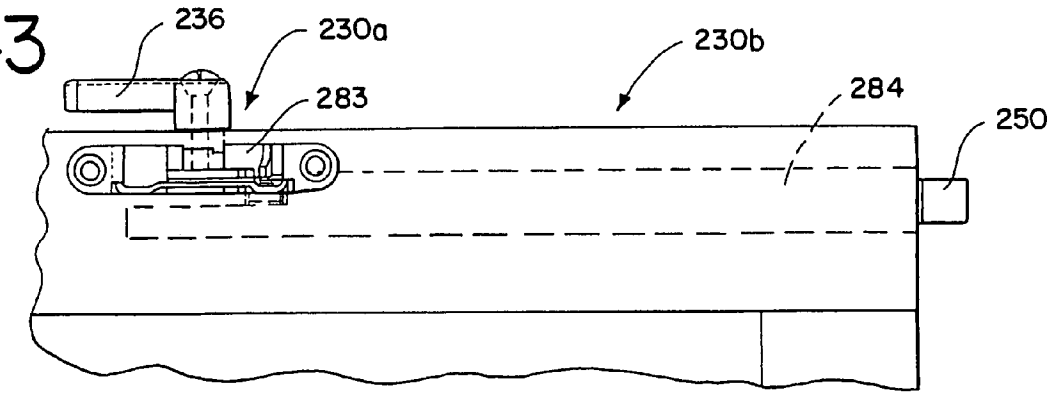
FIG. 43 is a partial front view a sash window incorporating the integrated assembly of FIG. 42.

The integrated assembly 230 generally includes a sash lock mechanism 230*a* and a tilt-latch mechanism 230*b*. The interaction between the sash lock mechanism 230*a* and the tilt-latch mechanism 230*b* will be described in greater detail below. FIGS. 42-43 illustrate one embodiment of the sash lock mechanism 230*a* according to the present invention. The sash lock mechanism 230*b* of the integrated assembly 230 generally includes a sash lock system 231 and a keeper 242.

As shown in FIGS. 42-56, the sash lock system 231 includes a handle 236, a rotor assembly 234, and a rotor assembly housing 232. The handle 236 of this embodiment of the integrated assembly 230 is operably coupled to the rotor assembly 234. As was described in the previous embodiments, the handle 236 is generally operable between three positions: the locked position, the unlocked position and the tiltable position.

The rotor assembly 234 is generally comprised of a rotor 235 having a locking cam 238 and a pawl 278. The rotor 235 has a first face 235a and a second face 238*b*. The locking cam 238 of the rotor 235 also has a slot 282 which will be described in greater detail below. In a preferred embodiment, the locking cam 238 is integral with the rotor 235. It is also contemplated, however, that the locking cam 238 be a discrete member which is separate from the rotor 234.

Figure 47:
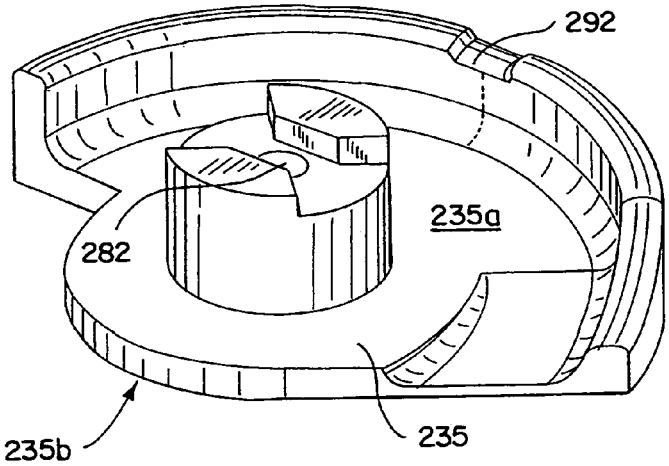
FIG. 47 is a perspective view illustrating a cam used in connection with the integrated assembly of FIG. 42.

As shown in FIG. 47, the pawl 278 is generally disposed proximate the second face 235b of the rotor 235. The pawl 278 comprises a base 287 and an appending member 289. The base 287 includes a tab 280 extending generally perpendicular from a top surface of the base 287. The tab 280 of the pawl 278 abuttingly engages the rotor 235 such that in operation, the rotor 235 and the pawl 278 generally move in unison. The appending member 289 may be biased by a spring within the tilt-latch bolt housing 252 or by an independent coil spring operably attached to the base 287 of the pawl 278.

Figure 48:
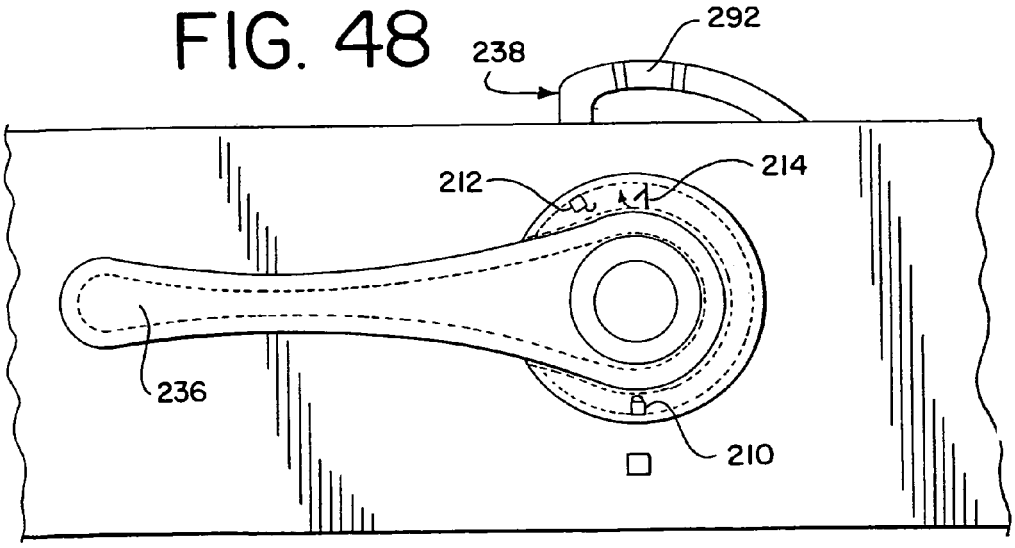
FIG. 48 is a partial plan view of a sash window having a sash lock handle utilized in the integrated assembly of FIG. 42 wherein a sash lock housing is not utilized.

FIG. 48 shows a plan view of the handle 236. As illustrated in FIG. 48, the handle 236 can have a plurality of symbols 210,212,214 to indicate to an operator certain operating positions of the integrated assembly 230. For example, the handle 236 is shown in a locked position with the locked symbol 210 being aligned with a base marking 216. When the handle 236 is rotated to an unlocked position, the unlocked symbol 212 will be aligned with the base marking 216. Similarly, when the handle 236 is further rotated to where the sash window can be tilted, the tilt or unlatch symbol 214 is aligned with the base marking 216. In this embodiment of the present invention, the handle 236 is made preferably of metal.

Figure 46:
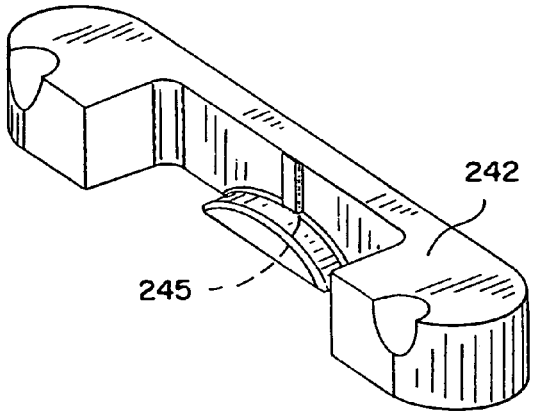
FIG. 46 is a perspective view illustrating a keeper used in connection with the integrated assembly of FIG. 42.

The keeper 242 is generally a bracketed structure having an opening 243 adapted to receive the locking cam 238 of the rotor 235. FIGS. 46 and 47 show one embodiment of the keeper 242 and rotor 235 utilized in the integrated assembly 230. In this embodiment, the keeper 242 has a protrusion 245 on an underside surface. The locking cam 238 has a notch 292. The protrusion 245 fits into the notch 292 when the sash lock assembly is locked to give an operator an indication that there is positive engagement between the locking cam 238 and the keeper 242. The keeper 242 can be made of any material suitable for the applications described herein.

FIGS. 51-56 generally disclose the tilt-latch mechanism 230*b*. The tilt-latch operation of the integrated assembly 230 is generally carried out by the handle 236 in cooperation with the tilt-latch mechanism 230*b*. The tilt-latch mechanism 230*b* generally includes a latch bolt assembly 249 and a connector 248. The latch bolt assembly 249 includes a latch bolt 250, a latch bolt housing 252 and a biasing means.

The latch bolt 250 is generally of the type described in reference to the preferred embodiments above. In particular, the latch bolt 250 generally has a first end 250*a*, a second end 250*b* and a nose 256 extending from the first end 250*a* that is adapted to engage a one of the guide rails 16 of the master frame 14. The latch bolt 250 is slidably disposed within the latch bolt housing 252. In one embodiment of the invention shown in FIG. 53, the second end of the latch bolt 250 is coupled to a slide 251 by the connector 248 (described in detail below). In this embodiment, both the latch bolt 250 and slide 251 are slidably disposed within the housing.

Figures 51, 52:
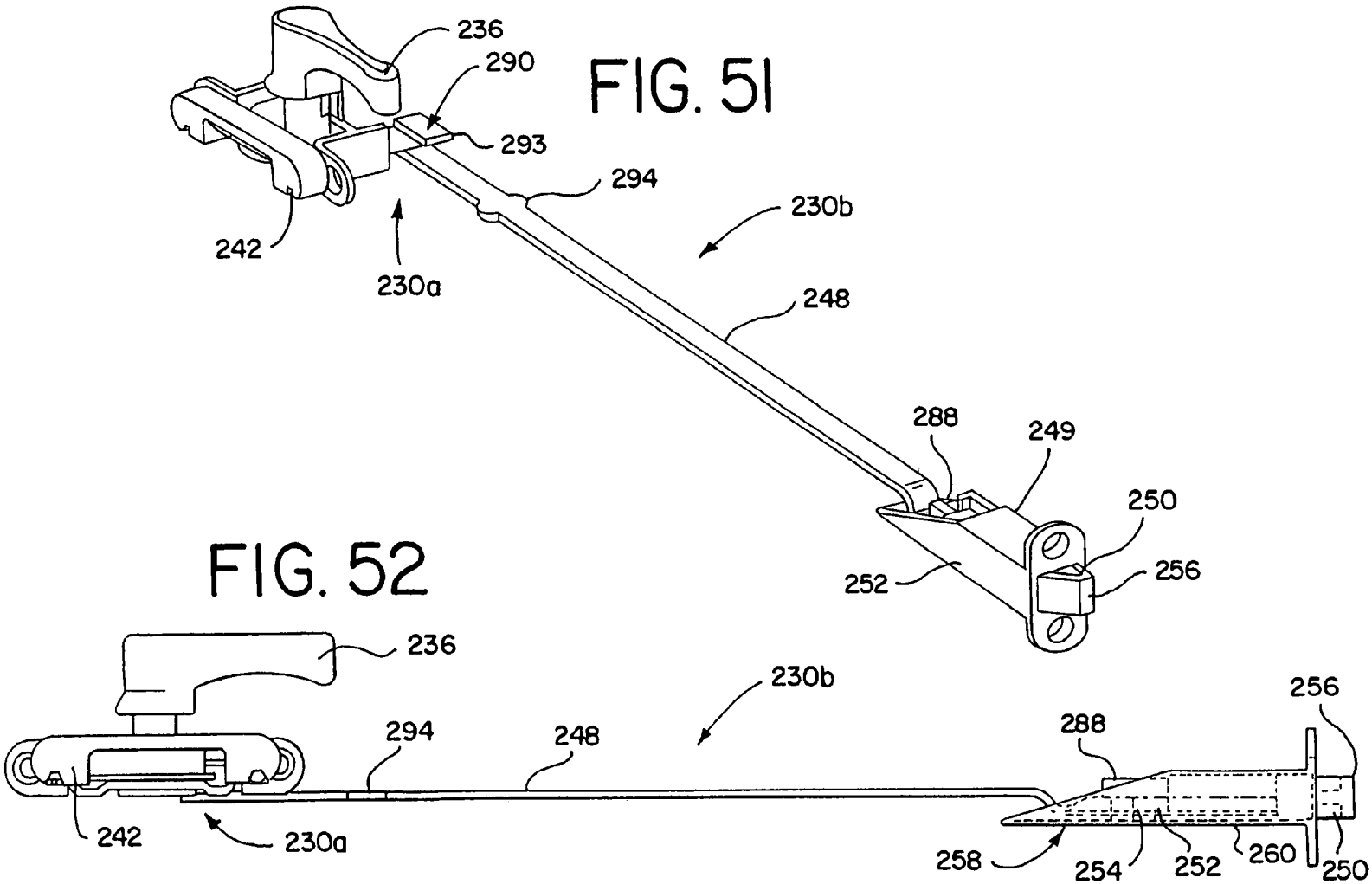
FIG. 51 is a perspective view of the integrated assembly of FIG. 42.
FIG. 52 is a side view of the integrated assembly of FIG. 51.
Figures 53, 54, 55:
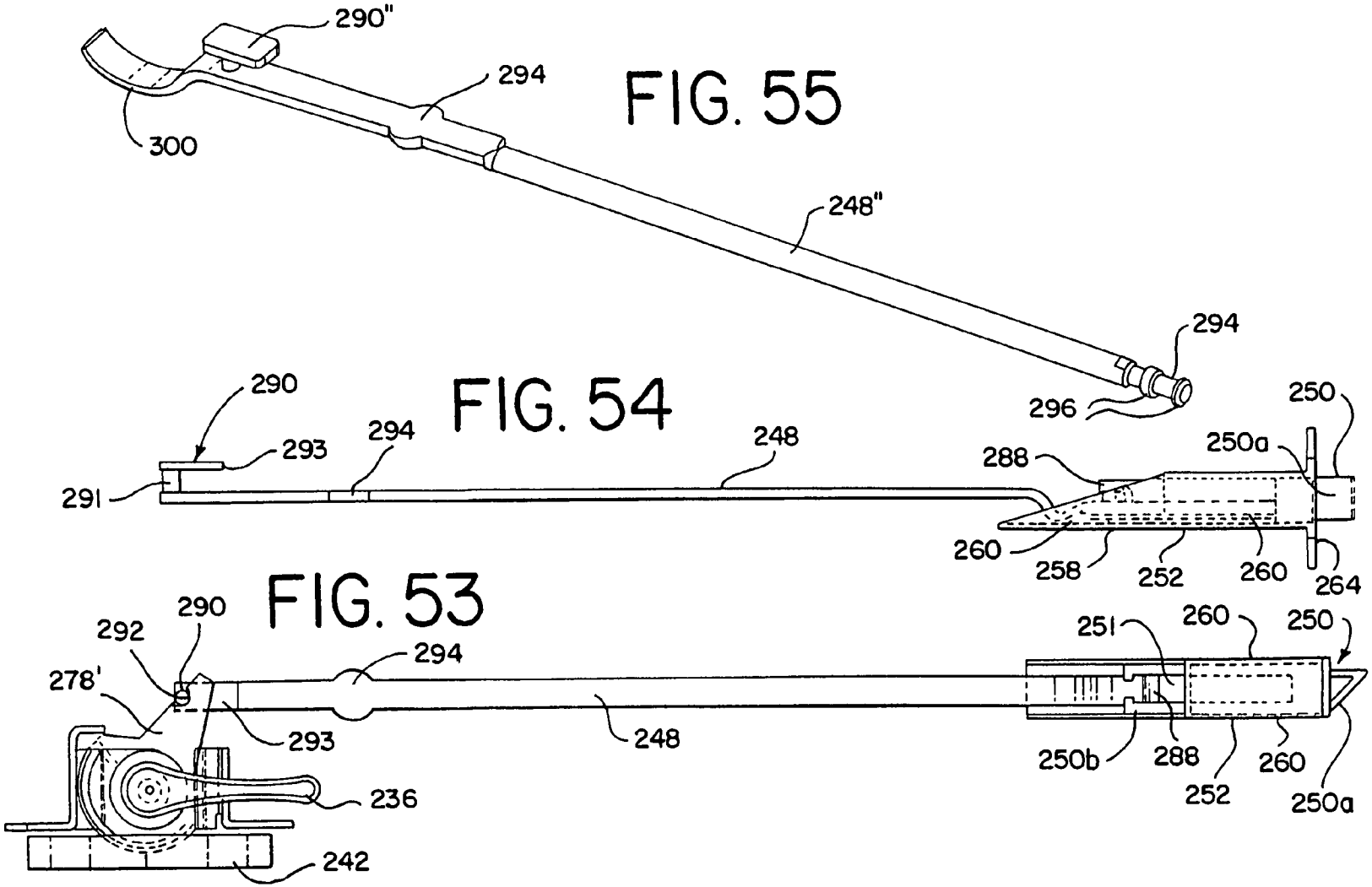
FIG. 53 is a top plan view of the integrated assembly of FIG. 51 with the pawl of FIG. 50.
FIG. 54 is a side view of a tilt-latch mechanism used in the integrated assembly of FIG. 51.
FIG. 55 is a perspective view of another embodiment of a connector used in connection with the integrated assembly of FIG. 32.
Figure 56:
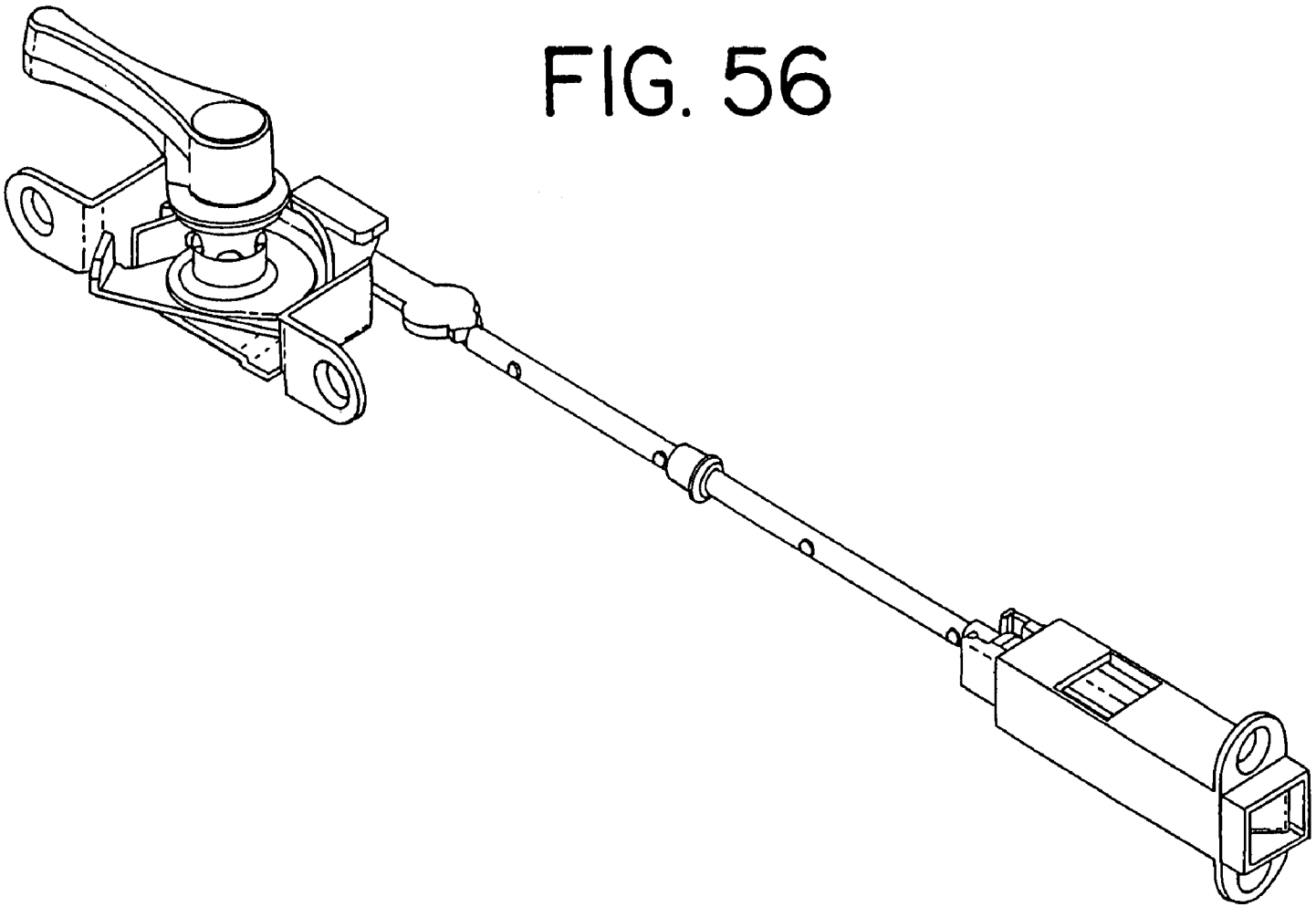
FIG. 56 is a perspective view of the integrated assembly of FIG. 42 showing the latch bolt in a retracted position.

As shown in FIGS. 51-53, the latch bolt housing 252 has a bottom wall 258 and a pair of opposing side walls 260 extending from the bottom wall 258. The latch bolt housing 252 further has a first end 264, a second end 266 and an outward end opening 262 adjacent the first end 264. In the preferred embodiment the latch bolt housing 252 is made of plastic suitable for mounting in wooden sash window frames, but could also be made of other materials. The latch bolt housing 252 of this embodiment is generally smaller in size than the other embodiments. It is understood than the latch bolt housings of the various embodiments described herein can vary in size. The means for biasing 254 the latch bolt 250 through the outward end opening 262 of the housing 252 is disposed in the housing 252. The means for biasing 254 typically comprises a spring although other structures that can force the latch bolt 250 through the outward end opening 262 are possible.

The connector 248 is operably connected at one end to the pawl 287, and at the opposed end to the latch bolt 250. According to one embodiment of the present invention, the connector 248 is a flexible cord. Preferably, however, that the connector 248 comprises a semi-flexible linkage. The connector 248 may be formed from various synthetic semi-flexible materials, including a flexible plastic, polyurethane or any other semi-flexible material suitable for such an application.

In one embodiment shown in FIGS. 51 and 54, one end of the connector 248 terminates in a first hook 288. The first hook 288 is connectable to a slot proximate the second end of the latch bolt 250*b*. The opposed end of the connector 248 terminates in a second hook 290 having a peg 291 and an overhang member 293. According to this embodiment, an alternate pawl 278 (FIG. 50) has a notch 292 in the appending member 289. The notch 292 of the pawl 278 engages, and fits around the peg 291 of the second hook 290. The overhang member 293 of the second hook 290 positioned over the pawl 278 prevents the connector 248 from inadvertently becoming disengaged from the pawl 278 when the latch bolt 250 retracts when the sash window is tilted back into a vertical position in the master frame.

The connector 248 can also includes a guide portion 294 for guiding the integrated assembly 230 within a channel in the sash rail. It is contemplated that the guide portion 294 be integrally formed into the connector 248 or a discrete member that attaches to the connector 248. The connector 248 further has an annular leg 253 generally adjacent the first hook 288 that places a remaining portion of the connector 248 in a raised vertical position with respect to the first hook 288' for the purpose of aligning the second hook 290 with the pawl 278.

An alternative embodiment of the connector is shown in FIG. 55, and generally referred to with the reference numeral 248". As seen in FIG. 54, at least a portion of the connector 248" is round according to this embodiment. The round portion terminates in a round snap link 294 having a plurality of snapping ridges 296 formed therein. In this embodiment, the round snap link 294 engages the latch bolt 250. This embodiment allows the latch bolt 250 and latch bolt housing 252 to rotate about the linkage during assembly such that the integrated assembly may be either a left assembly or a right assembly by turning the latch bolt 250 and latch bolt housing 252 180 degrees. The opposed end of the connector 248" terminates in the second hook 290 which engages the notch 292 in the pawl 278. The connector 248 further has a curved member 300 at a distal end generally adjacent the second hook 290. The curved member 300 keeps the peg 291 properly aligned for engagement with the pawl 278.

Figure 44:
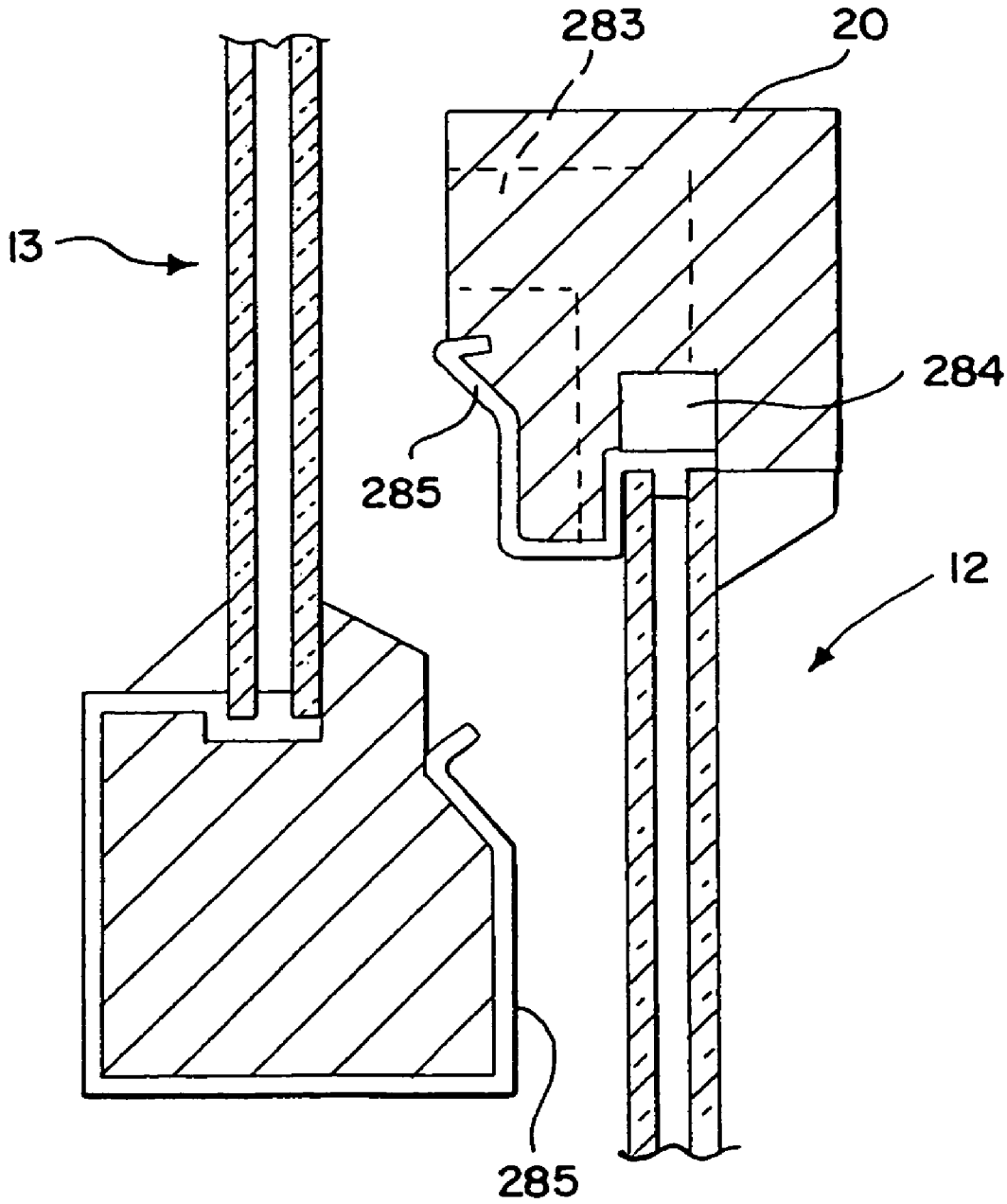
FIG. 44 is a partial cross-sectional end view of sash windows used with the integrated assembly of FIG. 42.
Figure 45:
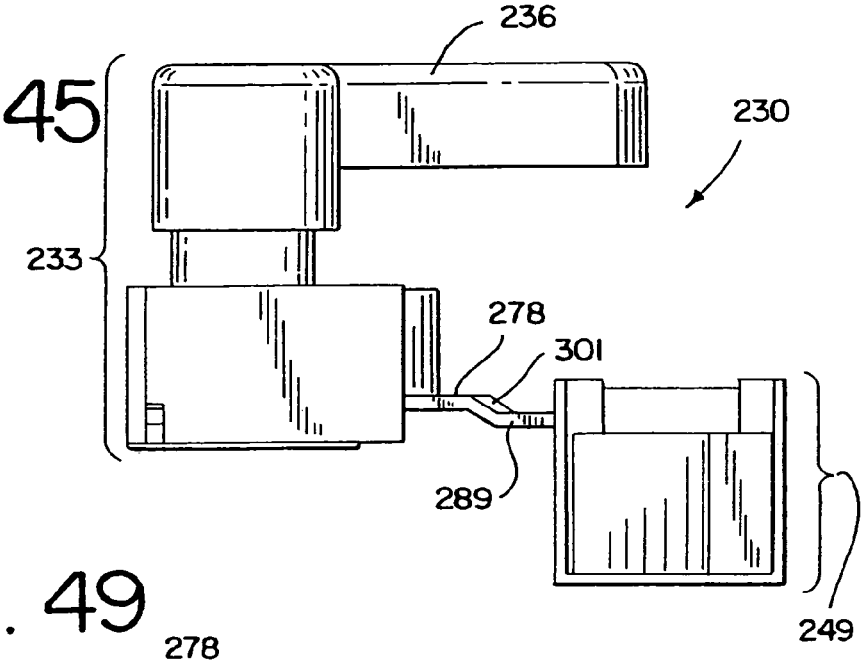
FIG. 45 is a schematic end view of the integrated assembly of FIG. 42.
Figure 49:
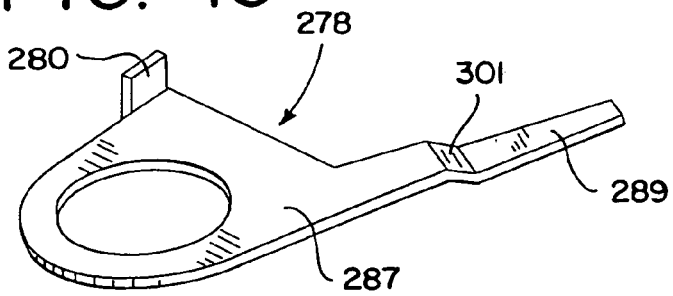
FIG. 49 is a perspective view of a pawl used in connection with the integrated assembly of FIG. 41.
Figure 50:
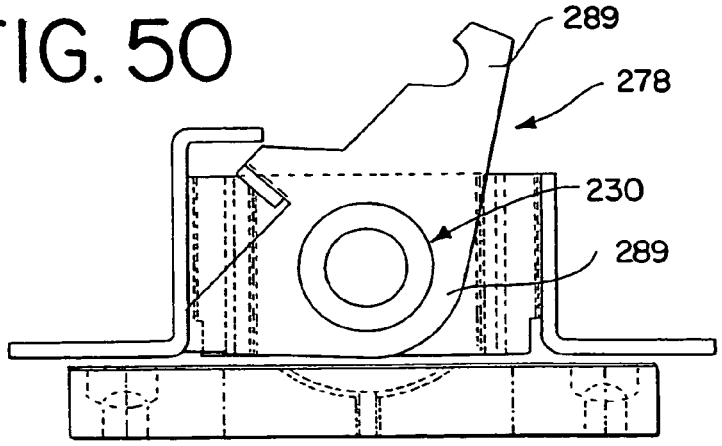
FIG. 50 is a partial top view of a sash lock mechanism of the integrated assembly of FIG. 32 showing an alternative embodiment of the pawl.

As shown in one embodiment illustrated in FIGS. 42-44, the sash lock housing 252 may be disposed in a first location 283 of the sash rail 20 that is laterally offset from, or misaligned with, a second location 284 of the top rail 20 in which the latch bolt housing 252 is disposed. It is understood that in a preferred embodiment, channels are routed into the top rail 20 of the wooden sash window 12 to accommodate the sash lock mechanism 230*a* and the tilt-latch mechanism 230*b*. In this embodiment, the appending member 289 of the pawl 278 includes a step portion 301 (FIG. 49). As shown in FIGS. 42-44 and 49, the base 287 of the pawl 278 will be mounted proximate the first location 283, which is at a higher location in the top sash rail 20 because the depth of the slot 282 at the first location 283 is limited by cladding 285 that protects the sash window 12. The step portion 252 allows the latch bolt housing 252 to be mounted at a lower depth in the rail 20 than the sash lock housing 252. Such a configuration facilitates a channel in the sash window rail 20 of sufficient depth to secure the latch bolt housing 252 with minimal compromise to the structural integrity of the rail 20. It is understood that the step portion 301 can vary for different sash window assembly configurations.

The operation of the integrated assembly 230 will now be described in detail. As discussed briefly above, in general, the sash lock operations are performed by the sash lock mechanism 230*a* of the integrated assembly 230, and the tilt latch operations are performed by the tilt-latch mechanism 230*b* of the integrated assembly 230. When the sash windows are in the locked position, the locking cam 238 engages the keeper 242 and the latch bolts 250 are fully, outwardly extended and engaged with the guide rails 16. Thus the lower sash window 12 is prevented from vertically opening and from tilting.

When the handle 236 is moved from the locked position to the unlocked position, the rotor 234 is rotated to a first angle from the locked position. This rotation disengages the locking cam 238 from the keeper 242, permitting the lower sash window to vertically open. However, the tab 280 of the pawl 278 is not yet engaged by the rotor 234 and thus the latch bolt 250 remains outwardly extended into the guide rail 16. Thus, the sash window 12 continues to be prevented from tilting.

When the handle 236 is moved from the unlocked position to the tiltable position, the rotor 234 is rotated a second angle from the locked position, wherein the second angle is greater than the first angle. In the tiltable position, the locking cam 238 remains disengaged from the keeper 242, still permitting the lower sash window 12 to vertically open. However, the tab 280 extending from the pawl 278 engages an abutting end of the rotor 234 as the rotor 234 is rotated, and the latch bolt 250 is inwardly retracted and released from the guide rail 16. (See FIG. 56). Thus, the sash window 12 is permitted to tilt. It is understood that this operation is performed for each integrated assembly 230 mounted on opposite sides of the top rail 20 of the lower sash window 12.

When operating the handle 236 in reverse to the above, the handle 236 is moved from the tiltable position to the unlocked position, and the rotor 234 is rotated back to the first angle. The locking cam 238 remains disengaged from the keeper 242, still permitting the sash window to vertically open. In the unlocked position, the pawl 278 moves towards its biased position as the pawl tab 280 no longer is rotatably biased by the rotor 234. A spring within the latch bolt housing 252 biases the pawl 278 to this position and further biases the latch bolt 250 outwardly into the guide rails 16. Thus, the sash window 12 is prevented from tilting.

When the handle 236 is moved from the unlocked position to the locked position. The cam 238 engages the keeper 242, preventing the sash window 12 from opening. Thus, the sash window 12 is still prevented from tilting, and the latch bolt 250 provides additional security against opening of the window.

The handle 236 and the upper side of the rotor 234 may include cooperating structures, such that the integrated assembly 230 produces an audible click, whenever the handle 236 reaches any of the locked, unlocked or released positions.

Figure 41:
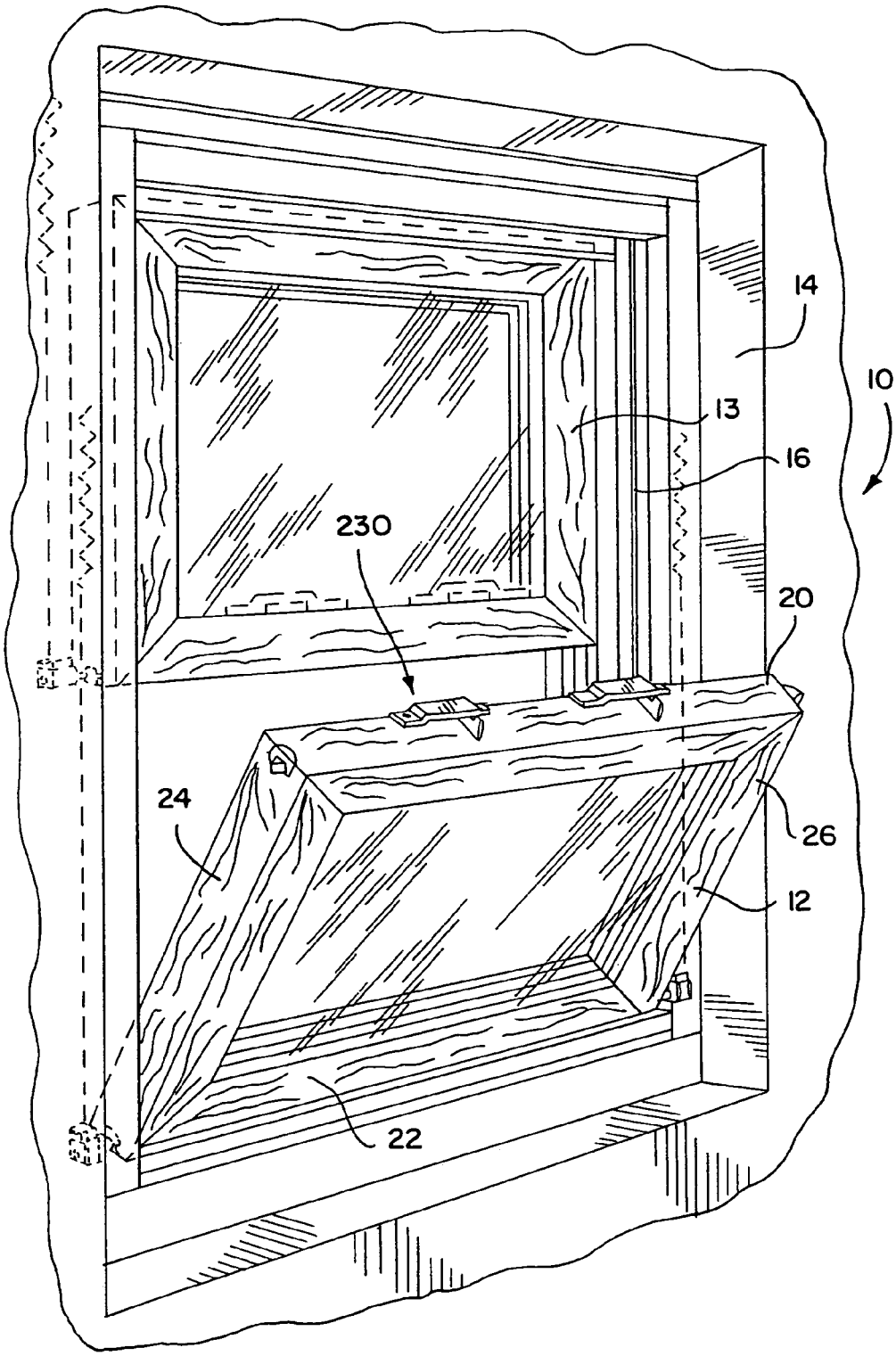
FIG. 41 is a perspective view of a sash window assembly incorporating another embodiment of an integrated tilt/sash lock assembly of the present invention.
Figure 57:
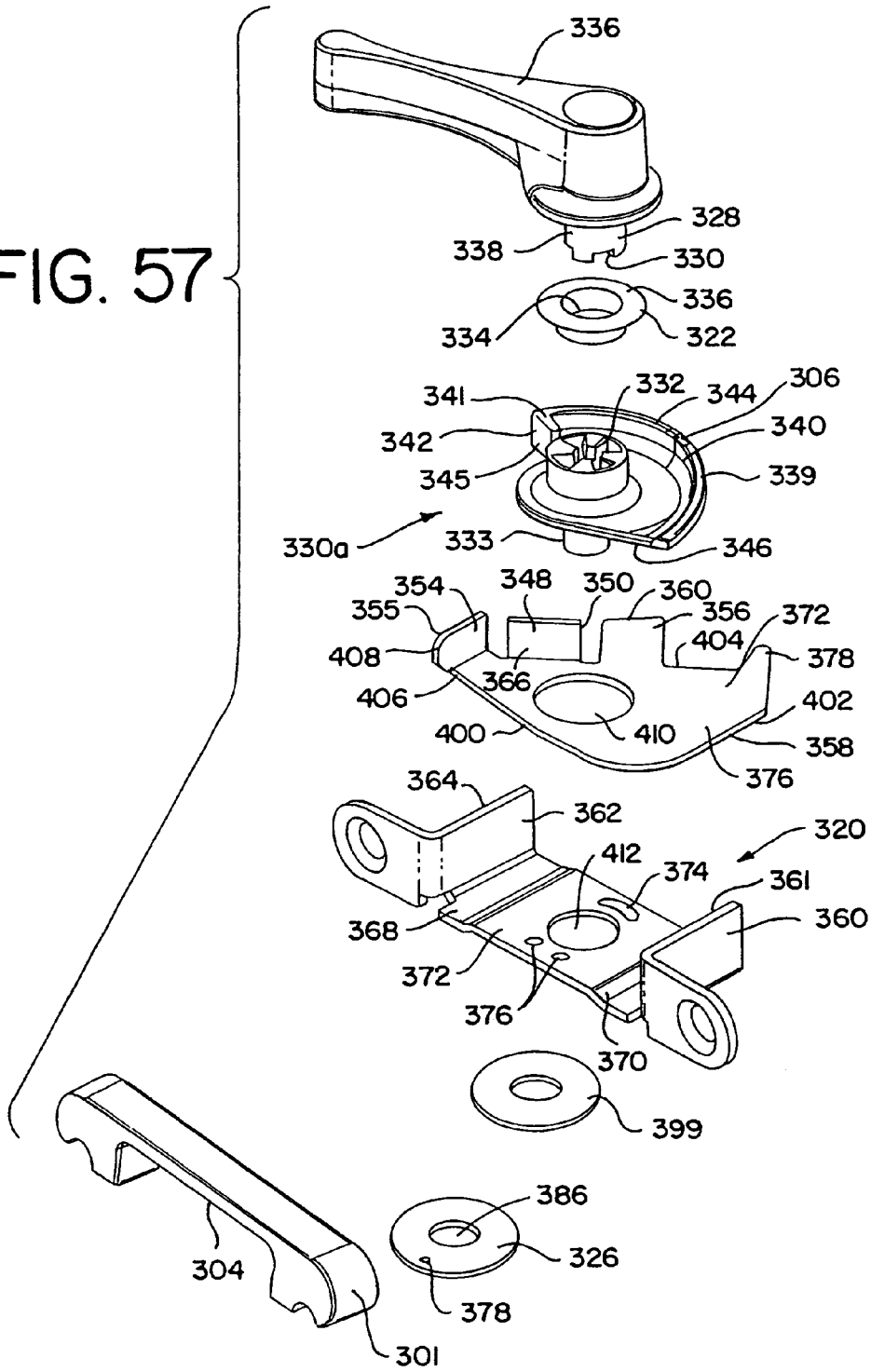
FIG. 57 is an exploded perspective view of another embodiment of the sash lock mechanism of the integrated assembly of FIG. 41.
Figure 58:
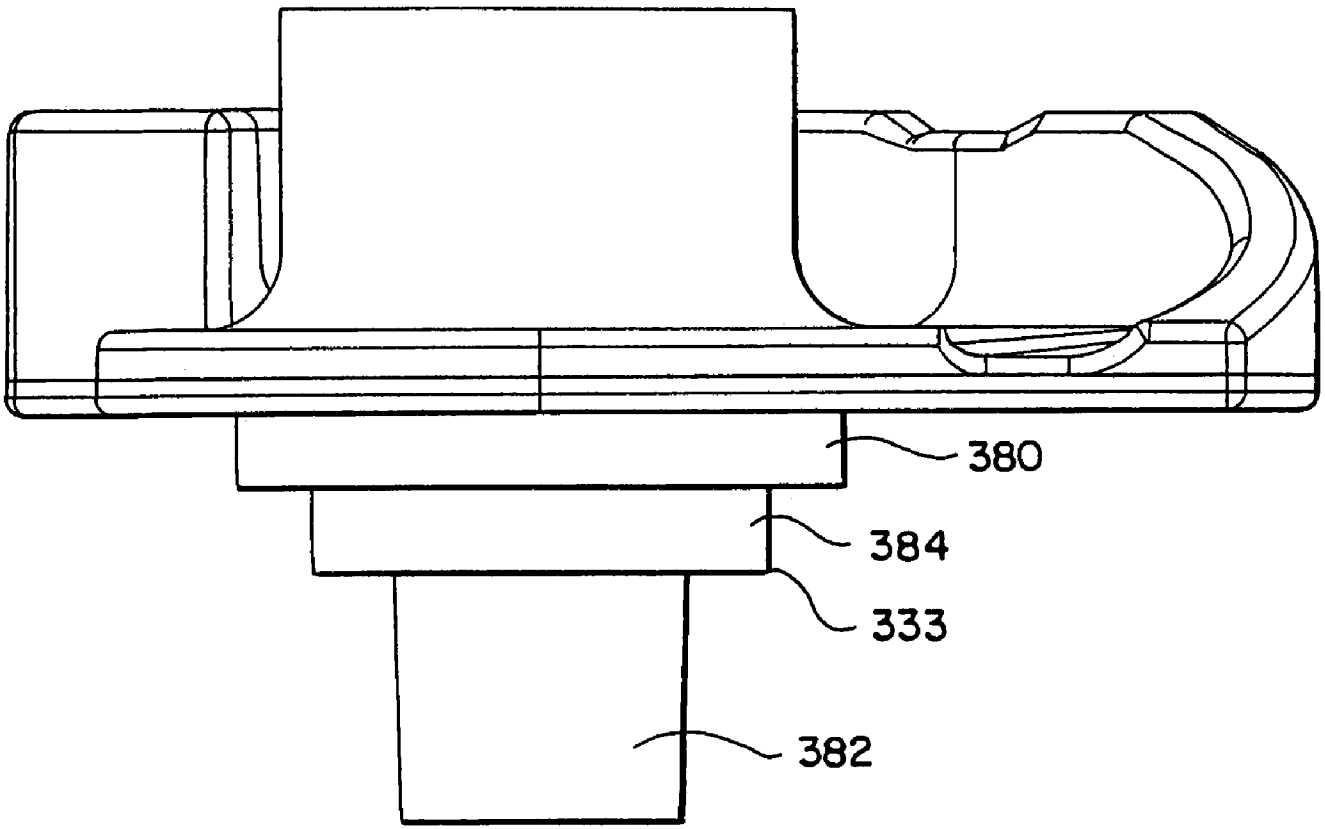
FIG. 58 is an enlarged side view of the rotor of the sash lock mechanism of FIG. 46.
Figure 59:
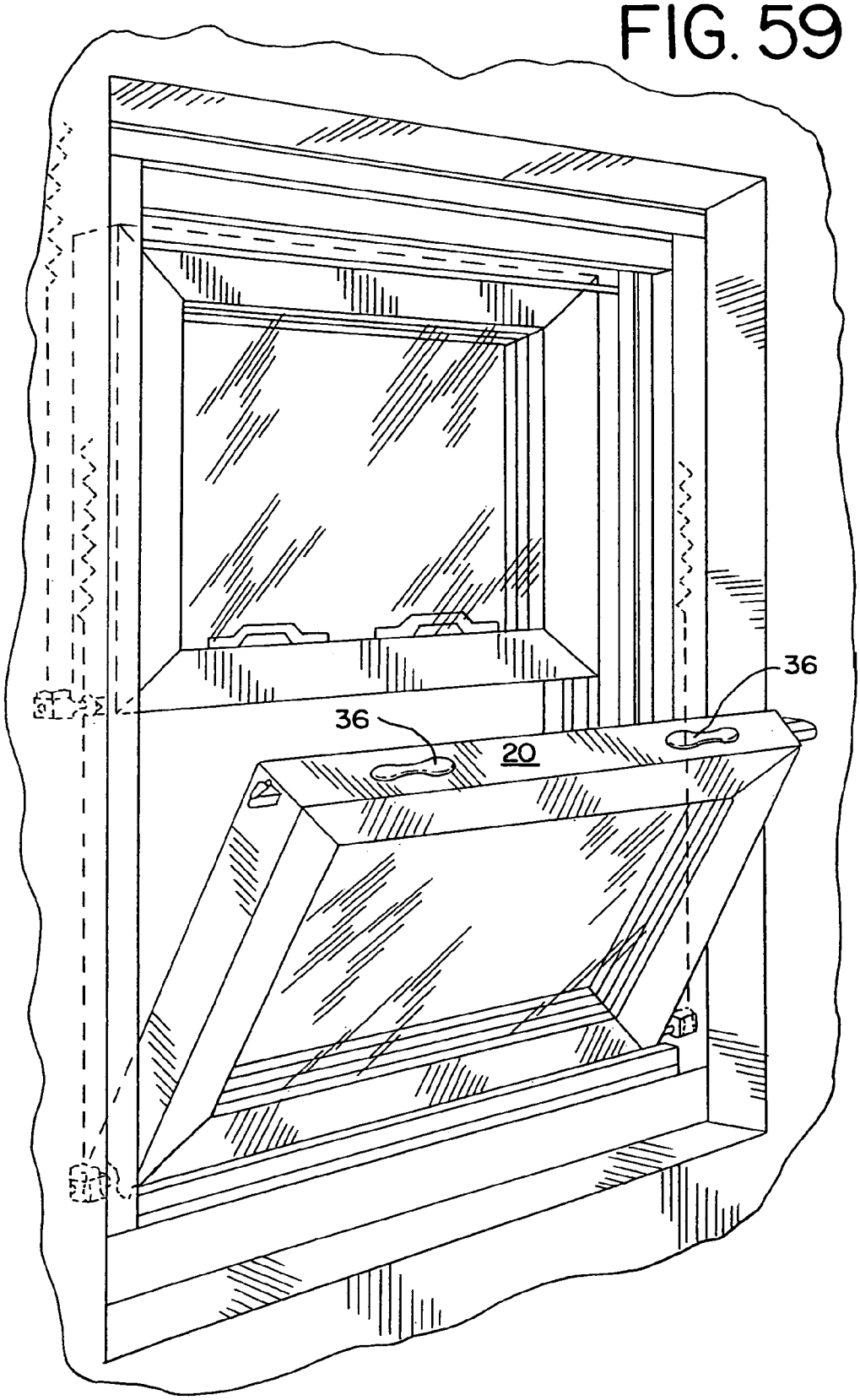
FIG. 59 is a perspective view of a sash window assembly incorporating another embodiment of the integrated tilt/sash lock assembly of the present invention and having a retractable sash lock handle.

FIGS. 57-58 disclose an alternative embodiment of the sash lock mechanism 230*a* used in the integrated assembly 230 of FIG. 41.

FIG. 57 discloses an exploded view of a sash lock mechanism 330*a* used in the integrated assembly 230 of the present invention. The sash lock mechanism 330*a* includes an actuator arm 336 operatively connected to a rotor 340 and washer 326. The sash lock mechanism 330*a* further includes a housing 320, a collar 122, an actuator plate or pawl 372 and a keeper 301.

The actuator arm 336 has a post 328, which extends in a longitudinally downward direction from the actuator arm 336, generally coaxial with a shaft 338. The post 328 has an end portion 330 adapted for cooperative engagement with the rotor 340. In the present embodiment, the end portion 330 has a stepped configuration adapted for operative engagement with a central portion 332 of the rotor 340. However, it is understood that the end portion 330 can have virtually any configuration that enables coupled connection with the rotor 340. The collar 322 provides intermediate support to the connection between the post 328 and the rotor 340. The collar 322 has an opening 334 adapted to receive the post 328 and rotor 340 and a flanged top portion 336, configured for confronting abutment with a lower portion of the actuator arm 336.

The rotor 340 is positioned intermediate to the actuator 336 and the pawl 372. The rotor 340 includes a locking cam surface 344. As shown, the locking cam surface 344 has a generally curved inclined surface 339 extending semi-annularly about the rotor 340. As such, the locking cam surface 344 enables sliding engagement with the keeper 301. The locking cam surface 344 also has a notch 306 adapted to receive a protrusion 304 of the keeper 301. Accordingly, when the sash lock mechanism 330*a* is in a locked position, the protrusion 304 is received by the notch 306. This engagement provides a "feel" indication to the operator that a positive engagement between the locking cam surface 344 and the keeper 301 has been formed, thus indicating the assembly in the locked position. The rotor 340 has a first end portion 341 defining an abutment surface 342. The abutment surface 342 has a generally planar first surface 345 adapted for abutting engagement with a first edge 350 of the first tab 348 of the pawl 372. The rotor 340 has an edge 346 provided for abutting engagement with an inner surface 366 of the first tab 148 of the actuator plate or pawl 372.

As shown in FIG. 57, the rotor 340 further includes a second post 333 extending generally downward from a bottom portion of the rotor 340. The second post 133 includes a first section 380 positioned adjacent to a lower portion of the rotor 340 proximate to the housing 320. The second post 333 further includes a second section 382, and an intermediate section 384 positioned intermediate to a lower portion of the first section 380 and an upper portion of the second section 182.

As shown in FIG. 57, the actuator plate or pawl 372 is positioned intermediate to the rotor 340 and the housing 320. The pawl 372 is configured for operative engagement with the rotor 340 and housing 320. As such, the pawl 372 includes an appending member 378, a first tab 348, a second tab 354, a finger 356, and a base 376. In the present embodiment, the base 376 has a generally foot-shaped configuration having non-parallel sides and defining a first side 400, a second side 402, a third side 404, and an end portion 406. The first side 402 of the actuator plate or pawl 372 has an edge 358 adapted for abutting engagement with an inner surface of the first upright 360 of the housing 320. The finger 356 of the base 376 extends generally outward from the third side 404 of the base 376. The finger 356 has an edge 360 configured for abutment with an inner surface 362 of a second upright 364.

The first tab 348 extends generally perpendicularly from the top surface of base 376 of the pawl 372. The first tab 348 has a generally planar configuration including an inner surface 366 and a first edge 350. The inner surface 366 provides an abutment for operative engagement with the abutting edge 346 of the rotor 340.

The second tab 354 provides a means for preventing actuation of the latch bolts 50 when the window is in a closed position. The second tab 354 extends generally perpendicularly upward from the top surface of the base 376 at the end 406 of the pawl 372. Preferably, the second tab 354 has a generally rounded edge 408, providing a sliding lead-in surface. In the event that the second tab 354 is extending slightly outward, such that if the keeper 301 or the window engages the tab 354 in an open position, the sliding surface enables the window to slide past the tab 354. The second tab 354 extends outward such that the sash assembly engages the keeper 301, thereby preventing the sash window 12 from tilting. The pawl 372 further includes an opening 410 adapted to receive the second post 333. Preferably, the opening 410 is adapted to receive the intermediate section 384 of the post 333.

The housing 320 includes a base portion 372 having a first end 370 and a second end 368. The housing 320 further includes a first upright 360 and a second upright 362. The first upright 360 extends generally perpendicularly upward from the top surface of the base portion 372 at the first end 370. The second upright 362 extends generally perpendicularly upwardly from the top surface of the base portion 372 at the second end 368. As such the first and second uprights 360, 362 are generally parallel to each other. The first upright 360 defines a first stop for abutting engagement with the edge 358 of the base 376 in a closed position. The second upright 362 defines a second stop adapted for abutting engagement with the edge 360 of the finger 356, in an open position. The housing 320 further includes a semi-annular slot 374 and one or more openings 376 adapted to receive a protrusion or dimple 378 from the washer 326. The slot 374 and opening 376 are positioned for cooperative engagement with a dimple 378 in the washer 326. Preferably, the housing 320 provides two openings 376. The second opening 376 enables the housing 320 to be a reversibly positioned on the top rail 20 in either a left assembly or right assembly as shown in FIG. 41. In this manner, the dimple 378 engages the second opening 376 of the base 376. The housing 320 further includes an opening 412 adapted to receive the post 333.

In the present embodiment, the washer 326 has a generally circular shape, however it is understood that the washer 326 can have virtually any shape without departing from the scope of the present invention. The washer 326 is positioned below the housing 320. The washer 326 includes an opening 386 adapted to receive the intermediate section 384 of the post 333. The washer 326 is rotatively coupled to the actuator 336 such that rotational movement of the actuator 336 rotates the washer 326. The dimple 378 or protrusion 378 of the washer 326 extends generally upwardly from a top surface of the washer 326 for engagement with the lower surface of the base 372. The protrusion 378 is coaxially aligned with the slot 374 and opening 376 of the base 372 enabling the protrusion 378 to be inserted into the opening 376 in a locked position, and slot 374 in a unlocked position. As further shown in FIG. 57, a nylon washer 399 may be provided between the washer 326 and housing 320. As the washer 326 and housing 320 are preferably made from the same material (e.g. metal), a nylon intermediary provides for an enhanced smooth and quite operation. It is noted that the nylon washer 399 is shown enlarged in FIG. 57 for ease of description. The nylon washer 399 is thin wherein the dimple 378 on the washer 326 will adequately deform the washer 399 to provide the "feel" indications described herein.

The rotor 340 is mounted to the actuator plate 372 and housing 320. As such, the first section 380 of the post 333 is inserted in the opening 410 of the actuator plate 372. In this arrangement, the opening 310 of the actuator plate 372 loosely fits around the outer surface of the first section 380 enabling the post 333 to rotate within the opening 410. The intermediate section 384 of the post 333 is inserted in the opening 412 of the housing 320. The opening 412 loosely fits around the intermediate section 384. The second section 382 of the post 333 is inserted in the opening 386 of the washer 326. The second section 382 is fastened to the washer 326. In the preferred embodiment, the end portion 392 of the second section 382 is spin formed, forming a head wherein the post 333 is fastened to the washer 326.

When the sash lock mechanism 330*a* is in a locked position, the protrusion 378 fits into the opening 376 providing the operator with a "feel" indication that the sash lock assembly is in a locked position. When the sash lock assembly is in an unlocked position, the protrusion 378 fits into the slot 374 providing a "feel" indication to the operator that the assembly 230 is in the unlocked-tiltable position. The slot 374 is sized to allow further rotation of the protrusion 378 within the slot 374 when the actuator arm is further rotated to retract the latch bolts.

In a locked position, the first edge 346 of the rotor 344 is in abutment with the inner surface 366 of the first tab 348. The outer surface 355 of the second tab 354 is positioned in a confronting relationship with the inner surface 362 of the second upright 364. As such, the protrusion 378 of the washer 326 is inserted into the opening 376 of the plate, providing a "feel" indication to the operator that the sash mechanism 330 is in the locked position. Additionally the edge 402 of the second side 358 of the pawl 372 is in confronting relation with the inner surface 361 of the first upright 360. The sash lock mechanism 330*a* can be rotated from the locked position to the unlocked position by rotating the actuator 336. The rotation moves the protrusion 378 into the slot 374 providing a "feel" indication that the assembly 230 is in the unlocked position. Further rotation of the actuator arm 336 causes the abutment surface 342 of the cam 344 to engage the edge 350 of the first tab 348. This engagement rotates the pawl 372 such that the appending member 378 pulls the connected latch bolt 250 to retract the latch bolt 250.

As discussed, the dimple 378/opening 376/ slot 374 arrangement provides a "feel" indication to the operator of the position of the assembly 230. The operator can tell or "feel" that the assembly 230 is in a locked position when the dimple 178 is received by the opening 176. The protrusion 304/notch 306 arrangement also provides a "feel" indication of the locked position. Similarly, the operator can tell, or "feel" that the assembly 230 is in an unlocked position wherein the latch bolts 250 can be retracted upon further rotation of the actuator arm 336 when the dimple 378 is received by the slot 374. It is further understood these cooperative engaging members provide further resistance to forced entry wherein an intruder attempts to use a tool to rotate the rotor from outside a housing or building to unlock the sash lock assembly.

As further discussed, the second tab 354 provides a means to prevent retraction of the latch bolt 250 when the window is in its closed position. When the window is in its closed position, the components of the sash lock mechanism 330*a* are vertically aligned. Thus, the second tab 354 is vertically aligned with the keeper 301. If the actuator arm 336 is rotated to a position to retract the latch bolt 250, the rotor 344 rotates the pawl 372 wherein the second tab 354 is rotated into engagement with the keeper 301. This engagement prevents further rotation of the actuator arm 336 wherein the appending member 378 of the pawl 372 is prevented from pulling the connector to retract the latch bolt 250. Thus, the latch bolts 250 cannot be retracted to tilt the window when the window is in its closed position. This prevents inadvertent retraction of the latch bolts 250 allowing for a tiltable window if an operator only wanted to unlock the sash lock assembly.

Accordingly, to place the window in a tiltable position, the window must first be raised vertically wherein the keeper 301 is vertically misaligned with the remaining components of the sash lock mechanism 330*a*. With this misalignment, the actuator arm 336 can be fully rotated to retract the latch bolts 250 because the second tab 354 will no longer engage the keeper 301. In the present embodiment the actuator arm 336 can be rotated until the finger 356 is in abutment with the inner surface 362 of the second upright 364.

In accordance with another embodiment of the invention, any of the above described integrated assemblies may include a system that allows for the hardware components of the integrated assembly to be retractable such that the hardware is substantially flush with the top surface of the top rail 20 of the sash window 12 and a substantially smooth line of sight is provided. Such a system generally includes a retractable handle 536 and a retracting mechanism 538 and is depicted in FIGS. 59-65.

Figure 60:
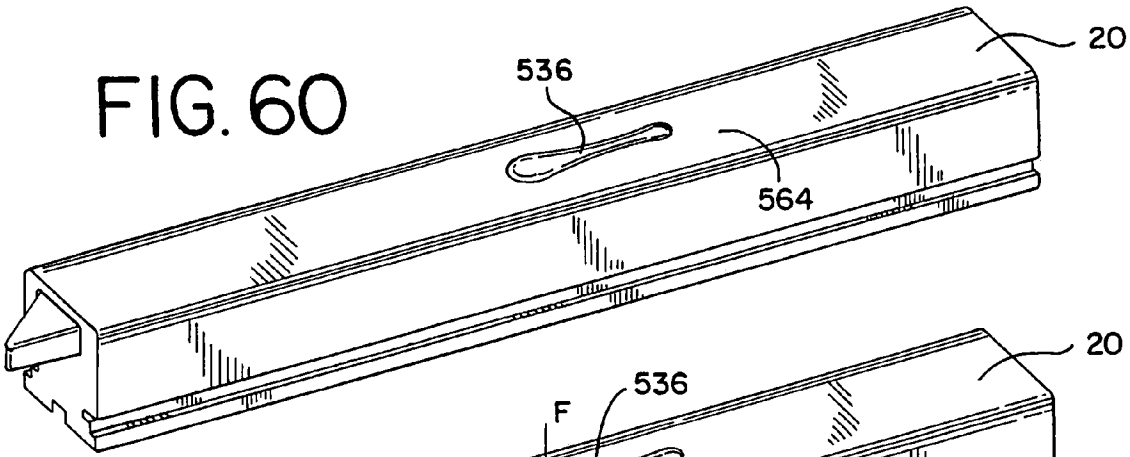
FIG. 60 is a partial perspective view of a top rail of a sash window incorporating the integrated assembly of FIG. 59 wherein the sash lock handle is in a retracted position.

The retractable handle 536 is movable between a retracted position (FIGS. 59-60) and an operational position (FIGS. 61-65). As illustrated in FIG. 60, when the handle 536 is in the retracted position, a top surface of the handle 336 is substantially flush with the top surface 564 of the top rail 20 such that a substantially smooth sight-line is provided. As shown in FIGS. 62-65, when the handle 536 is in the operational position, the handle 536 is projected above the top surface 564 of the top rail 20. In the operational position, the handle 536 is movable between a plurality of operational positions (see FIGS. 61-65). In particular, the handle 336 is operable between the three operational positions described above: locked, unlocked and tiltable.

The system also includes a retracting mechanism 538 that is operably associated with the handle 536. The retracting mechanism 538 is capable of moving the handle 536 between the retracted position (FIG. 60) and the operational position (FIGS. 62-65). The retracting mechanism 538 comprises a biasing means 560 disposed below the handle 536 and a catch 562 in cooperative engagement with the biasing means 560. The catch 562 disengages the biasing means 560 upon some predetermined stimulus, thereby causing the biasing means 560 to urge the handle 536 to the operational position (illustrated in FIG. 61). The biasing means 560 may be a spring or any other mechanism suitable for applying upward pressure to the handle 536. When biased to the operational position, the handle 536 has structure to cooperate with the additional structure 520 of the sash lock mechanism to operate the integrated assembly as described above.

Figure 61:
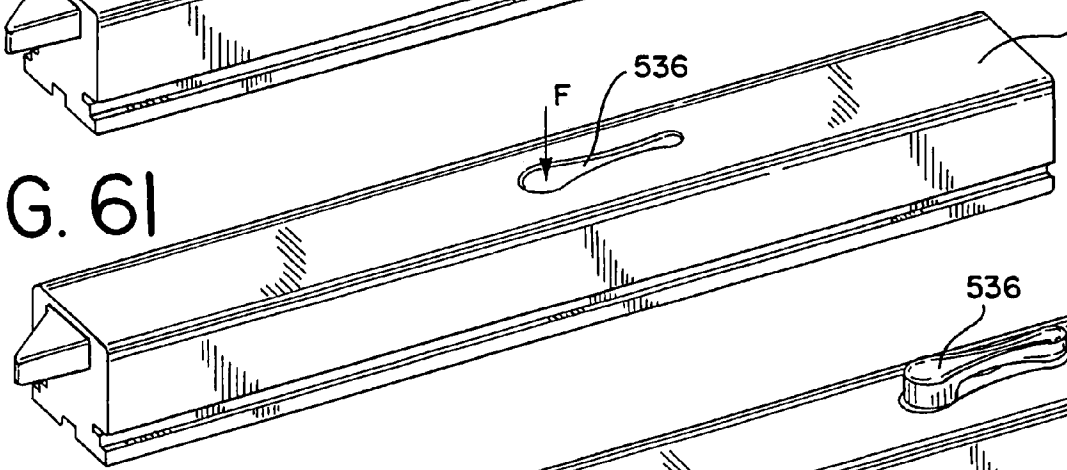
FIG. 61 is a partial perspective view of the top rail of FIG. 60 showing the retractable sash lock handle in a depressed position to move the handle from the retracted position to an operational position in accordance with the present invention.
Figure 62:
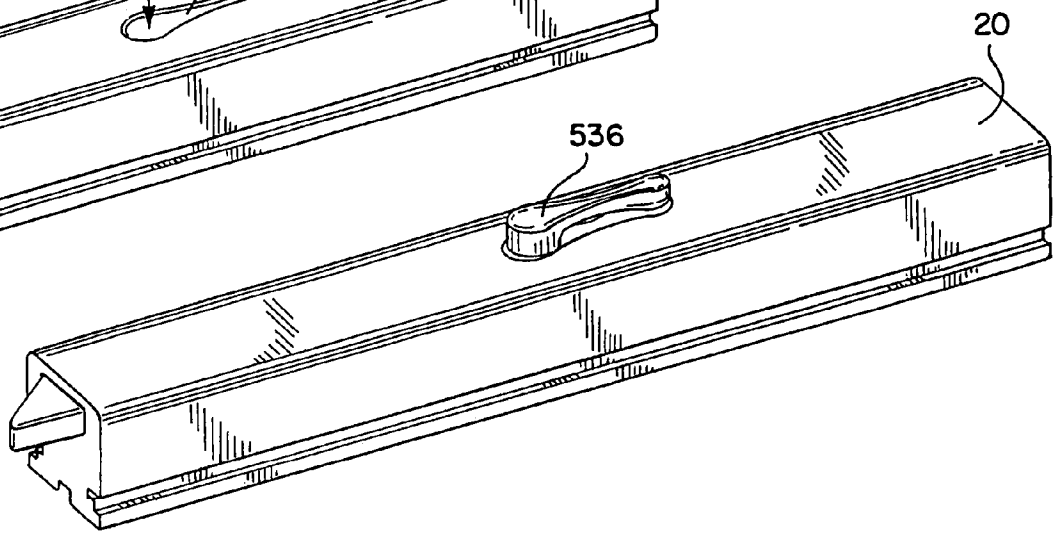
FIG. 62 is a partial perspective view of the top rail of FIG. 60 showing the retractable sash lock handle in the operational position in accordance with the present invention.
Figure 63:
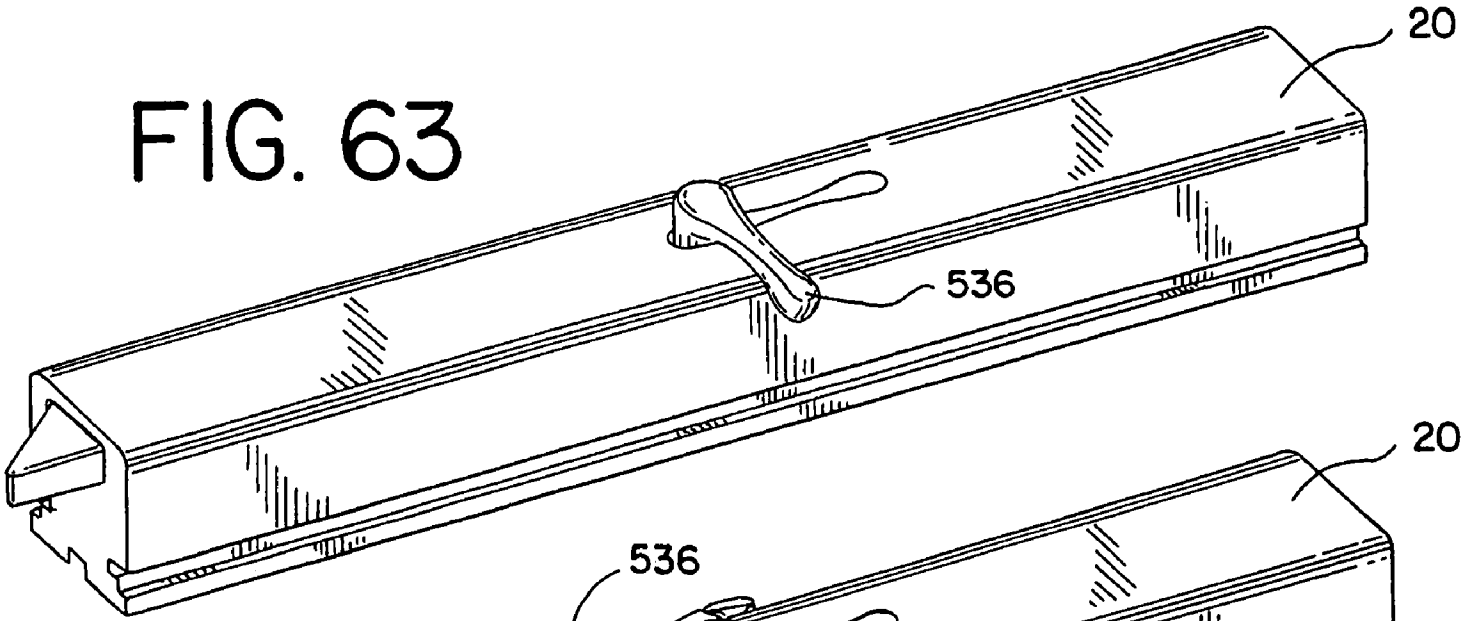
FIG. 63 is a partial perspective view of a top rail of FIG. 60 showing the retractable sash lock handle in the operational position and in an unlocked position in accordance with the present invention.
Figure 64:
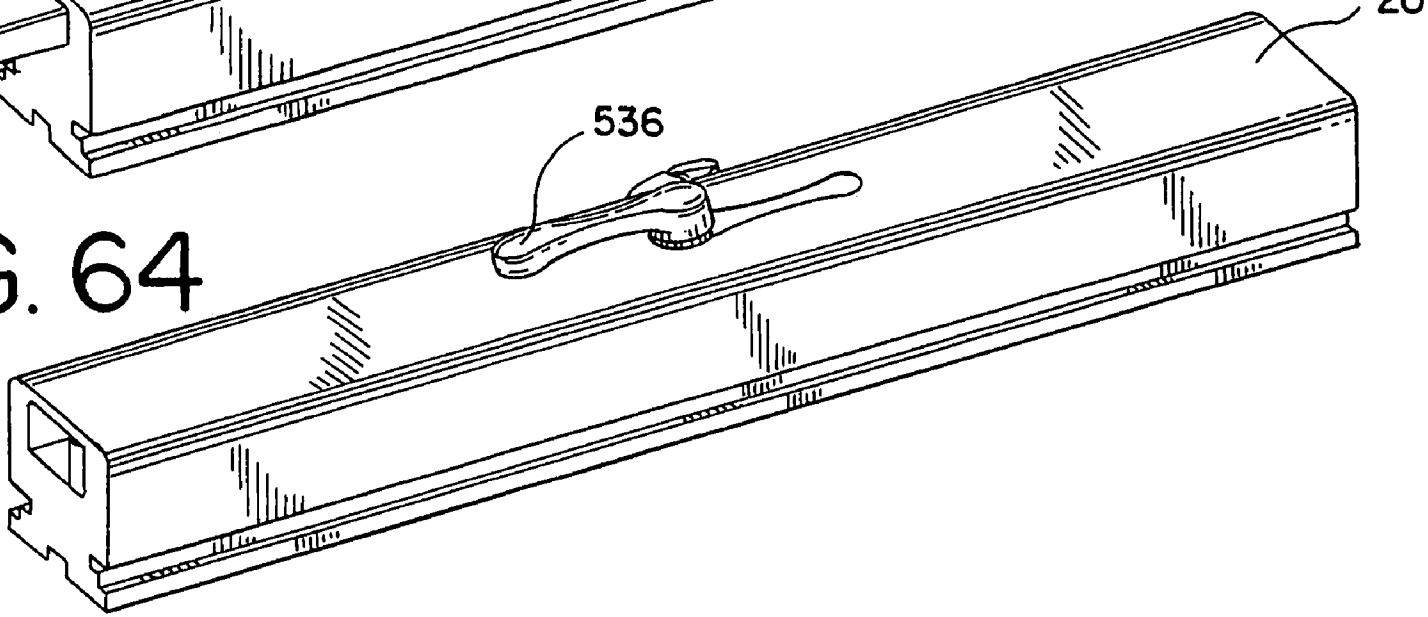
FIG. 64 is a partial perspective view of the top rail of FIG. 60 showing the retractable sash lock handle in the operational position and in a tiltable position in accordance with the present invention; and, FIG. 65 is a schematic partial cross-sectional view of the top rail of FIG. 60 showing a retractable actuating mechanism for the retractable sash lock handle of the present invention.
Figure 65:
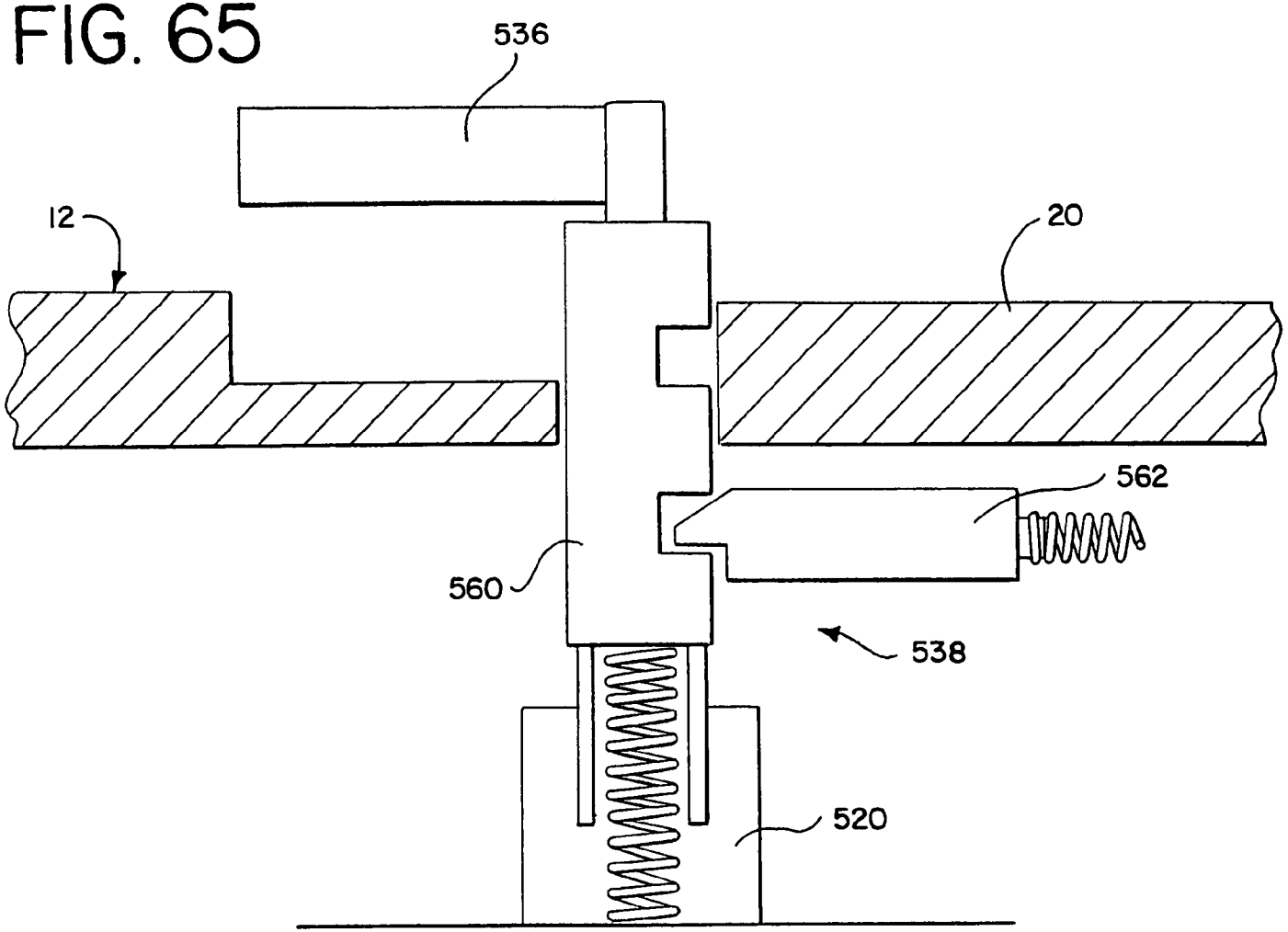

In one embodiment of the invention depicted in FIG. 61, the catch 562 can be designed to become disengaged from the biasing means when a user depresses the top surface of the handle 536. The downward pressure on the handle 536 moves the catch 562 out of contact with a resting surface on the biasing means 560. However, it is contemplated that the catch 562 may be disengaged from the biasing means 560 by depressing or sliding a separate button that is operably connected to the catch 562 or biasing means 560. With the handle 536 in a retracted position, a smooth light of sight is provided by the assembly.

While the integrated assembly of the present invention can be used in conventional double-hung window assemblies, it is understood that the integrated assembly could also be used in other types of window assemblies or other closure structures. In addition, it is understood that individual features of the various embodiments of the integrated assemblies described above can be combined as desired. It is further understood that the integrated assemblies described above can be utilized in sash window assemblies of various materials including vinyl, wood, composite or other types of materials. The individual components of the integrated assemblies can also be made from various materials as desired for a particular application. It is further understood that individual features of the invention may be utilized in sash window assemblies not incorporating an integrated assembly, but rather separate sash lock mechanisms and tilt-latch mechanisms. The sash lock mechanism could also be operable to engage a portion of the sash window assembly including the upper sash window wherein a keeper is not necessary.

While the above invention has been described as separate embodiments, it is contemplated that various aspects of each embodiment may be used in connection with each of the other embodiments without departing from the present invention. Further, while the specific embodiments have been illustrated and described, numerous modifications come to mind without significantly departing from the spirit of the invention and the scope of protection is only limited by the scope of the accompanying claims.

What is claimed is:

1. An integrated sash lock and tilt latch assembly for a sash window assembly, the sash window assembly having a sash window slideable within a master frame, the integrated sash lock and tilt latch assembly comprising:

a rotor having a locking cam;

a pawl comprising a base and an appending member, the pawl having a tab extending from a top surface of the base, the tab abuttingly engaging the rotor, wherein rotor and the pawl share a common axis of rotation;

a latch bolt adapted to be slidably disposed in the sash window;

a connector having a first end and an opposed second end, wherein the first end of the connector is coupled to the latch bolt and the second end of the connector operably engages the appending member of the pawl;

a means for biasing the latch bolt outwardly, the means for biasing being disposed in cooperative association with the latch bolt; and an actuator coupled to the rotor, the actuator movable among a first, a second and a third position to adjust the assembly among a respective locked, unlocked and tiltable position.

2. The integrated sash lock and tilt latch assembly of claim 1, further comprising a latch bolt housing adapted to be secured within the sash window, wherein the means for biasing the latch bolt is disposed in the latch bolt housing.

3. The integrated sash lock and tilt latch assembly of claim 1, further comprising means for selectively preventing movement of the actuator to the tiltable position.

4. The integrated sash lock and tilt latch assembly of claim 1, wherein the rotor and the pawl are disposed within a sash lock housing.

5. The integrated sash lock and tilt latch assembly of claim 1, wherein the connector comprises a semi-rigid connecting rod.

6. The integrated sash lock and tilt latch assembly of claim 1, wherein the second end of the connector terminates in a hook, the hook engaging a notch in the pawl.

7. The integrated sash lock and tilt latch assembly of claim 1, wherein at least a portion of the first end of the connector terminates in a snap link having a first plurality of snapping ridges, the snapping ridges cooperatively engaging a second plurality of snapping ridges in the latch bolt.

8. The integrated sash lock and tilt latch assembly of claim 1, further comprising a keeper for receiving at least a portion of the locking cam, the keeper disposed on the window assembly, wherein the keeper has a protrusion thereon and the locking cam has a notch, and the protrusion is received in the notch when the assembly is in the locked position.

9. The integrated sash lock and tilt latch assembly of claim 1, wherein the tab extends generally perpendicular from the top surface of the pawl.

10. An integrated sash lock and tilt latch assembly for a sash window assembly, the sash window assembly having a sash window slidable within a master frame, the sash window having a sash rail, the sash lock and tilt latch assembly comprising:

a rotor adapted to be supported within a first location of the sash rail, the rotor having a locking end;

a pawl operably connected to the rotor, wherein the rotor and the pawl share a common axis of rotation;

a latch bolt adapted to be supported within a second location of the sash rail, the second location offset from the first location, the latch bolt adapted to engage the master frame; and a connector having a first end and a second end, the first end connected to the latch bolt and the second end operably connected to the pawl; and an actuator operably connected to the rotor such that movement of the actuator is configured to cause movement of the rotor and the latch bolt, the actuator having a locked position wherein the locking end of the rotor is adapted to engage a portion of the sash window assembly, the actuator being moveable to an unlocked position wherein the rotor is adapted to be disengaged from the portion of the sash window assembly, and being further moveable to a tiltable position wherein the connector retracts the latch bolt so that the latch bolt is adapted to be disengaged from the master frame.

11. The integrated sash lock and tilt latch assembly of claim 10, wherein the connector comprises a semi-rigid connecting rod.

12. The integrated sash lock and tilt latch assembly of claim 10, wherein the connector is vertically offset from the rotor.

13. The integrated sash lock and tilt latch assembly of claim 10, wherein the connector is laterally offset from the rotor.

14. The integrated sash lock and tilt latch assembly of claim 10, wherein the pawl is rotatable about the axis of rotation, and wherein the latch bolt is laterally offset from the axis of rotation of the pawl.

15. An integrated sash lock and tilt latch assembly for a sash window assembly, the sash window assembly having a sash window slideable within a master frame, the integrated sash lock and tilt latch assembly comprising:

a rotor assembly adapted to be supported by the sash window, the rotor assembly comprising a rotor having a locking end and a pawl operably connected to the rotor, wherein the rotor and the pawl share a common axis of rotation;

a latch bolt adapted to be supported by the sash window and adapted to engage the master frame;

a connector having a first end connected to the rotor assembly and a second end connected to the latch bolt;

an actuator connected to the rotor assembly such that movement of the actuator is configured to cause movement of the rotor and the latch bolt, the actuator having a locked position wherein the rotor assembly is adapted to engage a portion of the sash window assembly, the actuator being moveable to an unlocked position wherein the rotor assembly is adapted to be disengaged from the portion of the sash window assembly, and the actuator being further moveable to a tiltable position wherein the connector retracts the latch bolt so that the latch bolt is adapted to be disengaged from the master frame; and means for preventing movement of the actuator from the unlocked position to the tiltable position.

* * * * *